US010351368B2

(12) United States Patent
Masuda

(10) Patent No.: US 10,351,368 B2
(45) Date of Patent: Jul. 16, 2019

(54) SHEET FEED DEVICE AND IMAGE FORMING APPARATUS INCLUDING THE SAME

(71) Applicant: Sharp Kabushiki Kaisha, Osaka (JP)

(72) Inventor: Junya Masuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/415,300

(22) Filed: Jan. 25, 2017

(65) Prior Publication Data

US 2017/0210583 A1 Jul. 27, 2017

(30) Foreign Application Priority Data

Jan. 27, 2016 (JP) ..... 2016-013241

(51) Int. Cl.

| | |
|---|---|
| ***B65H 1/08*** | (2006.01) |
| ***B65H 1/14*** | (2006.01) |
| ***B65H 1/04*** | (2006.01) |
| ***B65H 1/18*** | (2006.01) |
| ***B65H 7/02*** | (2006.01) |

(52) U.S. Cl.

CPC ..... *B65H 1/14* (2013.01); *B65H 1/04* (2013.01); *B65H 1/08* (2013.01); *B65H 1/18* (2013.01); *B65H 7/02* (2013.01); *B65H 2402/441* (2013.01); *B65H 2405/115* (2013.01); *B65H 2405/15* (2013.01); *B65H 2405/325* (2013.01); *B65H 2511/152* (2013.01); *B65H 2511/20* (2013.01); *B65H 2511/417* (2013.01); *B65H 2511/51* (2013.01); *B65H 2511/515* (2013.01); *B65H 2801/06* (2013.01)

(58) Field of Classification Search

CPC ... B65H 1/08; B65H 1/18; B65H 1/14; B65H 2405/115

See application file for complete search history.

(56) References Cited

U.S. PATENT DOCUMENTS

| | | | | |
|---|---|---|---|---|
| 4,504,053 | A * | 3/1985 | Shiozawa | B65H 1/14 271/157 |
| 7,722,032 | B2 * | 5/2010 | Sasaki | B65H 1/14 271/157 |
| 2005/0051946 | A1 * | 3/2005 | Otaki | B65H 1/14 271/147 |
| 2007/0200282 | A1 * | 8/2007 | Osoreda | B65H 1/14 271/9.08 |
| 2015/0225191 | A1 * | 8/2015 | Niikura | B65H 1/266 271/157 |
| 2016/0016740 | A1 * | 1/2016 | Niikura | B65H 3/48 271/162 |

FOREIGN PATENT DOCUMENTS

| | | |
|---|---|---|
| JP | 02-243425 | 9/1990 |

* cited by examiner

*Primary Examiner* — Jeremy R Severson

(74) *Attorney, Agent, or Firm* — Renner, Otto, Boisselle & Sklar, LLP

(57) ABSTRACT

A sheet feed device includes: a stacking tray on which sheets are stacked in such a manner as to be capable of being lifted and lowered; and an opening/closing member. When the opening/closing member is open, a sheet stacking surface on which the sheets are stacked is positioned at a position higher, in an upper and lower direction of the sheet feed device, than an uppermost portion of the opening/closing member in the upper and lower direction.

15 Claims, 10 Drawing Sheets

(a)

(b)

(a)

(b)

(a)

(b)

SHEET FEED DEVICE AND IMAGE FORMING APPARATUS INCLUDING THE SAME

CROSS-REFERENCE TO RELATED APPLICATIONS

The present application claims the benefit of priority to Japanese Patent Application No. 2016-013241, the entirety of which is incorporated herein by reference, filed on Jan. 27, 2016 under Section 119(a) of 35 U.S.C.

BACKGROUND ART

Field of the Invention

The present invention relates to a sheet feed device that feeds a sheet, such as a recording sheet, in a predetermined sheet feed direction, and an image forming apparatus, such as a copier, a multifunction peripheral, a printer, or a FAX machine, including the same.

Description of the Related Art

One conventionally known sheet feed device (what is known as a sheet feeder) that feeds a sheet, such as a recording sheet, in a predetermined sheet feed direction includes: a stacking tray on which sheets, such as recording sheets, are stacked in a liftable manner; and an openable (for example, an openable cover) (for example, Japanese Unexamined Patent Application Publication No. 2-243425).

For example, when the sheet feed device no longer includes the sheets on the stacking tray, a user performs a sheet supplying operation for supplying the sheets, with the openable member open.

In such a conventional sheet feed device, when the openable member is open, a sheet stacking surface, on which the sheets are stacked, of a stacking tray is positioned lower than an uppermost portion of the openable member in the upper and lower direction of the sheet feed device. Thus, the sheet supplying is hindered by the uppermost portion of the openable member in the upper and lower direction, and thus the operability of the sheet supplying operation for supplying the sheet is compromised.

The conventional sheet feed device may include a casing accommodating a stacking tray and employ a configuration in which the sheet is supplied from one side in a left and right direction with respect to the front surface of the casing. In this configuration, the sheet supplying (in particular, sheet supplying from the front surface) is hindered by the front surface of the casing, and thus the operability of the sheet supplying operation for supplying the sheets is compromised.

The conventional sheet feed device may include a position restricting member that restricts the position of the sheets stacked on the stacking tray and the openable member may be openable and closable around a pivot shaft extending along a restricting direction in which the position restricting member restricts the position of the sheets. In this configuration, when the openable member is open, the sheet supplying operation is hindered by the uppermost portion of the openable member. Thus, the operability of the sheet supplying operation for supplying the sheet is compromised.

SUMMARY OF THE INVENTION

The present invention provides a sheet feed device that includes a stacking tray on which sheets are stacked and an openable member, and can achieve a higher operability of a sheet supplying operation for supplying sheets, and provides an image forming apparatus including the same.

The present invention provides sheet feed devices of first to third aspect and an image forming apparatus described below.

(1) A Sheet Feed Device According to a First Aspect

A sheet feed device according to a first aspect of the present invention includes: a stacking tray on which sheets are stacked in such a manner as to be capable of being lifted and lowered; and an opening/closing member. When the opening/closing member is open, a sheet stacking surface on which the sheets are stacked is positioned at a position higher, in an upper and lower direction of the sheet feed device, than an uppermost portion of the opening/closing member in the upper and lower direction.

(2) A Sheet Feed Device According to a Second Aspect

A sheet feed device according to a second aspect of the present invention includes: a stacking tray on which sheets are stacked in such a manner as to be capable of being lifted and lowered; an opening/closing member; and a casing accommodating the stacking tray. The opening/closing member is configured to be openable and closable in such a manner that the sheets are supplied from one side of a left and right direction of the sheet feed device, and the casing has a front surface with the one side partially notched to have a notched portion (3) A Sheet Feed Device According to a Third Aspect A sheet feed device according to a third aspect of the present invention includes: a stacking tray on which sheets are stacked in such a manner as to be capable of being lifted and lowered; an opening/closing member; and a position restricting member configured to restrict a position of the sheets stacked on the stacking tray. The opening/closing member is configured to be openable and closable around a rotational axis along a restricting direction in which the position of the sheets is restricted by the position restricting member, and the position restricting member and the opening/closing member are configured in such a manner that when the opening/closing member is open, a distance larger than a size of the sheets is provided between an end portion of the position restricting member on a side of the opening/closing member and an uppermost portion of the opening/closing member in the upper and lower direction.

(4) Image Forming Apparatus

An image forming apparatus according to an aspect of the present invention includes the sheet feed device according to any one of the first to the third aspect.

In the sheet feed device according to the first aspect, the sheet stacking surface may be an upper surface of the stacking tray, when the sheets are not on the stacking tray.

In the sheet feed device according to the first aspect, the sheet stacking surface may be an upper surface of an uppermost one of the sheets, when the sheets are stacked on the stacking tray.

The sheet feed device according to the first aspect may further include: a lifting/lowering control unit configured to lift and lower the stacking tray; and an opening/closing member detection unit configured to detect an open/closed state of the opening/closing member. The lifting/lowering control unit may be configured to control a lifting/lowering operation for the stacking tray. When closing of the opening/closing member is detected by the opening/closing member detection unit, the lifting/lowering control unit may control the lifting/lowering operation for the stacking tray in such a manner that the sheet stacking surface is positioned at an upper position higher than a predetermined sheet supplying position at which the sheets are supplied.

The sheet feed device according to the first aspect may further include a sheet detection unit configured to detect a presence of the sheets on the stacking tray. When the presence of the sheets on the stacking tray is detected by the sheet detection unit and closing of the opening/closing member is detected by the opening/closing member detection unit, the lifting/lowering control unit may control the lifting/lowering operation for the stacking tray in such a manner that the sheet stacking surface is positioned at the upper position.

In the sheet feed device according to the first aspect, when opening of the opening/closing member is detected by the opening/closing member detection unit, the lifting/lowering control unit may control the lifting/lowering operation for the stacking tray in such a manner that the sheet stacking surface is lowered from the upper position to be positioned at the sheet supplying position.

The sheet feed device according to the first aspect may further include: a lifting/lowering control unit configured to lift and lower the stacking tray; a sheet detection unit configured to detect a presence of the sheets on the stacking tray; and an opening/closing member detection unit configured to detect an open/closed state of the opening/closing member. The lifting/lowering control unit may be configured to control the lifting/lowering operation for the stacking tray. When an absence of the sheets on the stacking tray is detected by the sheet detection unit and closing of the opening/closing member is detected by the opening/closing member detection unit, the lifting/lowering control unit may control the lifting/lowering operation for the stacking tray in such a manner that the sheet stacking surface is positioned at a predetermined sheet supplying position at which the sheets are supplied.

In the sheet feed device according to the first aspect, when opening of the opening/closing member is detected by the opening/closing member detection unit, the lifting/lowering control unit may control the lifting/lowering operation for the stacking tray in such a manner that the sheet stacking surface is maintained at the sheet supplying position.

The sheet feed device according to the first aspect may further include: a lifting/lowering control unit configured to lift and lower the stacking tray; a sheet detection unit configured to detect a presence of the sheets on the stacking tray; and an opening/closing member detection unit configured to detect an open/closed state of the opening/closing member. The lifting/lowering control unit may be configured to control the lifting/lowering operation for the stacking tray. When an absence of the sheets on the stacking tray is detected by the sheet detection unit and closing of the opening/closing member is detected by the opening/closing member detection unit, the lifting/lowering control unit may control the lifting/lowering operation for the stacking tray in such a manner that the sheet stacking surface is positioned at a lower position lower than a predetermined sheet supplying position at which the sheets are supplied.

In the sheet feed device according to the first aspect, when opening of the opening/closing member is detected by the opening/closing member detection unit, the lifting/lowering control unit may control the lifting/lowering operation for the stacking tray in such a manner that the sheet stacking surface is lifted from the lower position to be positioned at the sheet supplying position.

The sheet feed device according to the first aspect may further include a sheet supplying position detection unit configured to detect whether the sheet stacking surface of the stacking tray is higher than the sheet supplying position. When the sheet stacking surface is detected to be higher than the sheet supplying position by the sheet supplying position detection unit, the lifting/lowering control unit may perform a lowering operation for the stacking tray, and when the sheet stacking surface is detected to become not higher than the sheet supplying position by the sheet supplying position detection unit, the lifting/lowering control unit may stop the lowering operation for the stacking tray.

In the sheet feed device according to the second aspect, the notched portion maybe formed in a corner portion between an upper edge of the front surface of the casing and a side edge on the one side.

In the sheet feed device according to the second aspect, the opening/closing member may be configured to cover the notched portion when the opening/closing member is closed.

The sheet feed device according to the second aspect may further include comprising a back surface side position restricting member configured to restrict a movement of the sheets stacked on the stacking tray toward a back surface side opposite to a side of the front surface. The notched portion may also serve as an opening portion through which the back surface side position restricting member can be visually recognized.

In the sheet feed device according to any one of the first to the third aspects, the opening/closing member is opened and closed in a sheet feed direction in which the sheets are fed.

The present invention can improve the operability of the sheet supplying operation for supplying sheets.

BRIEF DESCRIPTION OF THE DRAWINGS

FIG. 3 is a diagram illustrating a sheet supplying operation on the sheet feed device illustrated in FIG. 1 and FIG. 2, in which FIG. 3A is a schematic perspective view illustrating a state where an openable cover is closed, and FIG. 3B is a schematic cross-sectional view schematically illustrating an internal configuration in a state where the openable cover is closed.

FIG. 4 is a diagram illustrating a sheet supplying operation on the sheet feed device illustrated in FIG. 1 and FIG. 2, in which FIG. 4A is a schematic perspective view illustrating the state where the openable cover is open, and FIG. 4B is a schematic cross-sectional view schematically illustrating an internal configuration in the state where the openable cover is open.

FIG. 5 is a diagram illustrating a sheet supplying operation on the sheet feed device illustrated in FIG. 1 and FIG. 2, in which FIG. 5A is a schematic perspective view illustrating a state where one bundle of sheets is supplied in the state where the openable cover is open, and FIG. 5B is a schematic cross-sectional view schematically illustrating an internal configuration in the state where one bundle of sheets is being supplied with the openable cover open.

FIG. 8 is a schematic cross-sectional view schematically illustrating lifted and lowered states of the stacking tray achieved by the lifting/lowering device in the sheet feed device, in which FIG. 8A illustrates a state where the openable cover is closed with no sheet P on the stacking tray, and FIG. 8B illustrates a state where an openable cover is open.

FIG. 9 is a schematic cross-sectional view schematically illustrating lifted and lowered states of the stacking tray achieved by the lifting/lowering device in the sheet feed device, in which FIG. 9A illustrates a state where an operation of loading one bundle of sheets on the stacking tray is in process, FIG. 9B illustrates a state where the operation of loading one bundle of sheets on the stacking tray is completed, and FIG. 9C illustrates a state where an operation of loading a next bundle of sheets is in process, with the stacking tray lowered.

DESCRIPTION OF THE EMBODIMENTS

An embodiment of the present invention is described below with reference to the drawings.

(Overall Configuration of Image Forming Apparatus)

Figure 1:
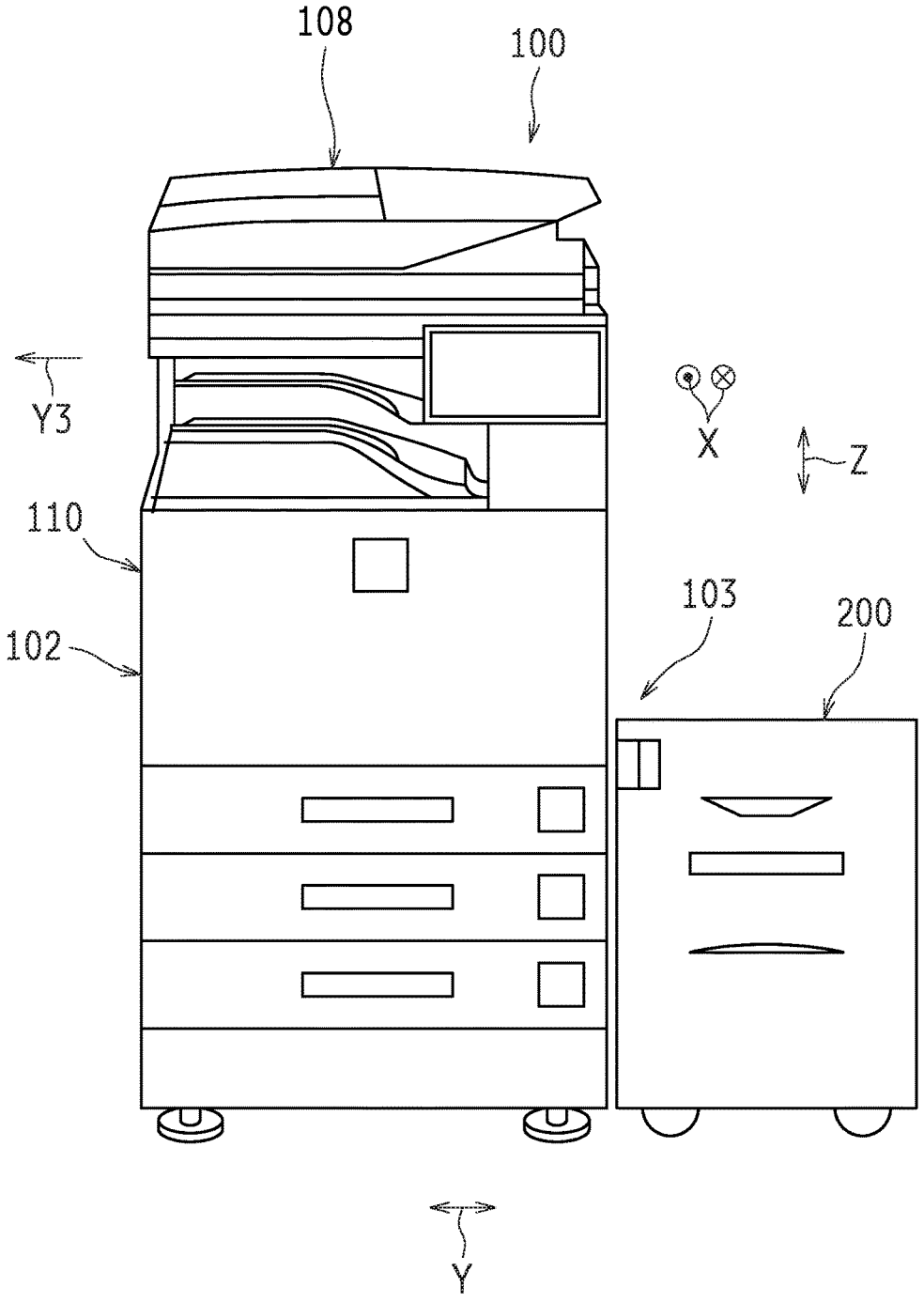
FIG. 1 is a schematic front view of an image forming apparatus including a sheet feed device according to an embodiment.
Figure 2:
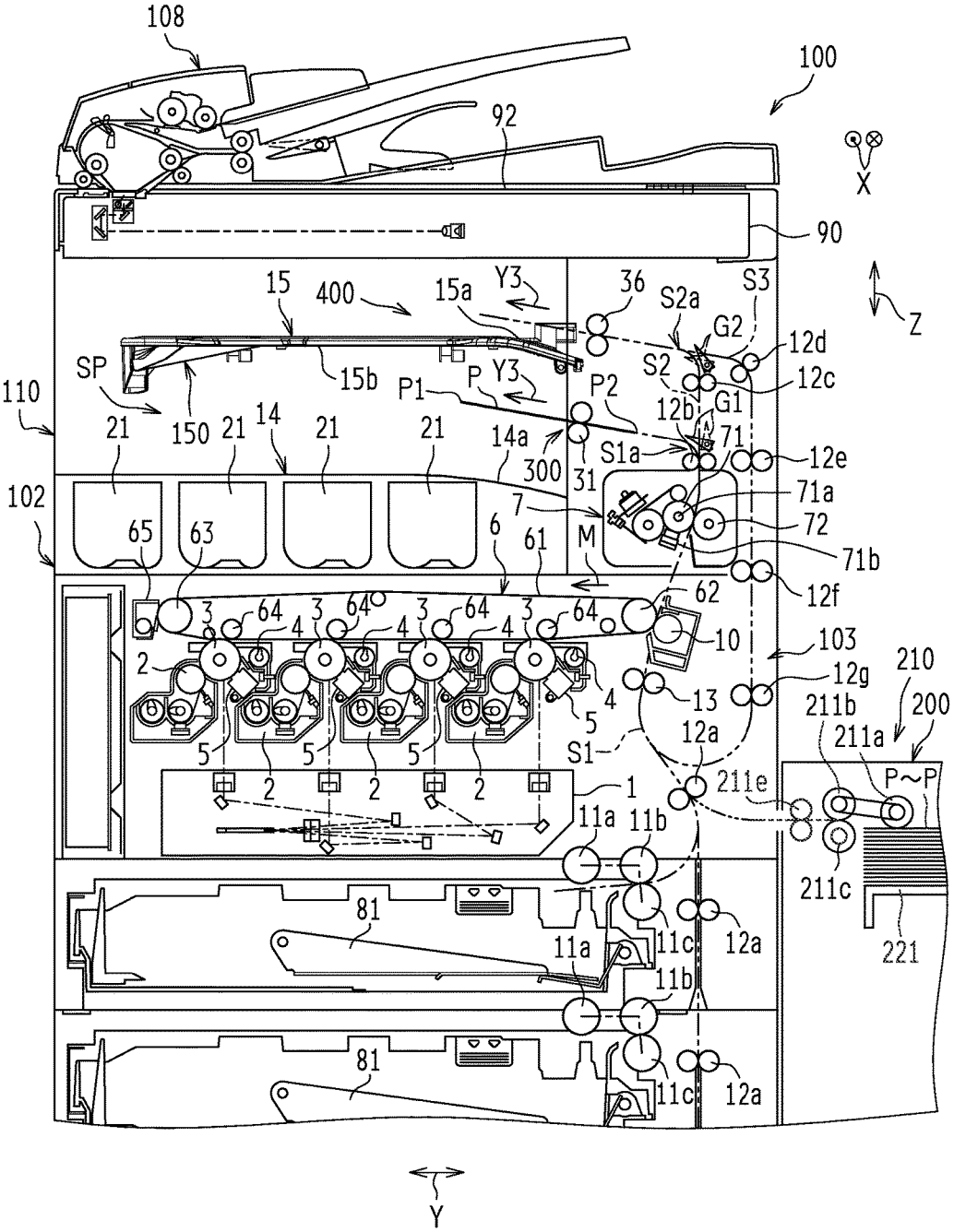
FIG. 2 is a schematic cross-sectional front view of the image forming apparatus according to the present embodiment.

FIG. 1 is a schematic front view of an image forming apparatus 100 including a sheet feed device 200 according to the present embodiment. FIG. 2 is a schematic cross-sectional front view of the image forming apparatus 100 according to the present embodiment.

The image forming apparatus 100 illustrated in FIG. 1 and FIG. 2 is a color image forming apparatus that forms a multicolor or monochrome image on a sheet P (see FIG. 2) such as a recording sheet, in accordance with image data transmitted thereto from the outside. The image forming apparatus 100 includes: a document read apparatus 108; an image forming apparatus main body 110; and the sheet feed device 200 (what is known as a sheet feeder, which is a large capacity sheet feeder in this example) (see FIG. 1). The image forming apparatus main body 110 includes an image forming unit 102 and a sheet conveyance system 103. More specifically, the image forming apparatus 100 is a multi-function peripheral having a copy function, a printer function, and a facsimile function.

As illustrated in FIG. 2, the image forming unit 102 includes an exposing unit 1, a plurality of development units 2 to 2, a plurality of photosensitive drums 3 to 3, a plurality of cleaning units 4 to 4, a plurality of charging units 5 to 5, an intermediate transfer belt unit 6, a plurality of toner cartridge units 21 to 21, and a fixing unit 7.

The sheet conveyance system 103 includes a paper feed tray 81, the sheet feed device 200, a discharge tray 14, and a sheet discharge device 400.

The sheet discharge device 400 includes a sheet sorting unit 300 and an upper discharge tray 15. The sheet sorting unit 300 sorts the sheet P, discharged by discharge rollers 31, by shifting the discharge rollers 31 in an axial direction (shift direction) (depth direction X) of the discharge rollers 31. The discharge rollers 31 convey the sheet P in a predetermined conveyance direction Y3, so that the sheet P is discharged onto the discharge tray 14. The upper discharge tray 15 is disposed above the discharge tray 14 with a space SP in between. The discharge tray 14 may be a component of the sheet discharge device 400.

A platen 92 made of a transparent glass piece, on which a document (not illustrated) is placed, is provided in an upper portion of the image forming apparatus main body 110. An optical unit 90 that reads the document is disposed below the platen 92. The document read apparatus 108 is disposed on an upper side of the platen 92. The document read apparatus 108 automatically conveys the document onto the platen 92. The document read apparatus 108 is rotatably attached to the image forming apparatus main body 110. Thus, a front surface side can be opened to open a space on the platen 92 to enable manual placement of the document.

The document read apparatus 108 can read a document automatically conveyed thereto, and a document placed on the platen 92. An image of the document read by the document read apparatus 108 is transmitted as image data to the image forming apparatus main body 110 of the image forming apparatus 100. In the image forming apparatus main body 110, an image formed based on the image data is recorded on the sheet P.

The image data used in the image forming apparatus 100 corresponds to a color image using a plurality of colors (in this example, colors black (K), cyan (C), magenta (M), and yellow (Y)). Thus, a plurality of sets (in this example, four sets corresponding to black, cyan, magenta, and yellow) of the development units 2 to 2, the photosensitive drums 3 to 3, the cleaning units 4 to 4, the charging units 5 to 5, and the toner cartridge units 21 to 21 are provided to form a plurality of types of (in this example, four types) images corresponding to the colors. Thus, a plurality of (in this example, four) image stations are provided.

The charging units 5 to 5 uniformly charge surfaces of the photosensitive drums 3 to 3 to achieve a predetermined potential. The exposing unit 1 exposes each of the charged photosensitive drums 3 to 3 in accordance with the image data input, so that electrostatic latent images corresponding to the image data are formed on the surfaces of the photosensitive drums 3 to 3. The toner cartridge units 21 to 21 contain toner to be supplied to developer tanks of the development units 2 to 2. The development units 2 to 2 develop the electrostatic latent image formed on the photosensitive drums 3 to 3 with the toner of four colors (Y, M, C, and K). The cleaning units 4 to 4 remove and collect the toner remaining on the surfaces of the photosensitive drums 3 to 3, after the developing and image transferring.

The intermediate transfer belt unit 6 disposed above the photosensitive drums 3 to 3 includes: an intermediate transfer belt 61 serving as an intermediate transfer member; an intermediate transfer belt driving roller 62; an intermediate transfer belt driven roller 63; a plurality of intermediate transfer rollers 64 to 64; and an intermediate transfer belt cleaning unit 65.

Four intermediate transfer rollers 64 to 64 corresponding to the colors Y, M, C, and K are provided. The intermediate transfer belt 61 is spanned by the intermediate transfer belt driving roller 62, the intermediate transfer belt driven roller 63, and the intermediate transfer rollers 64 to 64. When the intermediate transfer belt driving roller 62 is drivingly rotated, the intermediate transfer belt 61 is rotationally moved in a movement direction M, and the intermediate transfer belt driven roller 63 and the intermediate transfer rollers 64 to 64 are driven to be rotated. Transfer bias, for transferring the toner images, formed on the photosensitive drums 3 to 3, onto the intermediate transfer belt 61, is applied to the intermediate transfer rollers 64 to 64. The intermediate transfer belt 61 is provided to be in contact with the photosensitive drums 3 to 3. The toner images of the corresponding colors formed on the photosensitive drums 3 to 3 are transferred onto a surface of the intermediate transfer belt 61 in an overlapping manner. Thus, a color toner image (multicolor toner image) is formed on the surface. The toner image on the intermediate transfer belt 61 is transferred onto the sheet P by a transfer roller 10. The toner remaining on the intermediate transfer belt 61 without being transferred onto the sheet P is removed and collected by the intermediate transfer belt cleaning unit 65.

One or a plurality of stages (three stages in this example) of the paper feed trays 81 are disposed below the exposing unit 1 in the image forming apparatus main body 110, and each accommodate the sheet P on which the image is to be formed (printed) through the process described above. In the sheet feed device 200, the sheets P on which the image is to be formed (printed) are accommodated while being stacked on a stacking tray 221. In this example, the sheet feed device 200 is a large capacity sheet feeder that accommodates a large amount of (for example at least 1000 sheets) sheets P. For example, the large capacity sheet feeder is referred to as a large capacity sheet feed cassette or a large capacity paper feed tray. The sheet feed device 200 is described in detail later.

The discharge tray 14 is disposed above the image forming unit 102 in the image forming apparatus main body 110. The sheets P on which the image has been formed (printed) are stacked face down on the discharge tray 14. The discharge tray 14 has a configuration in which an upstream side of a placement surface 14*a*, on which the sheet P is placed, is positioned lower than a downstream side in the conveyance direction Y3 of the sheet P. The discharge tray 14 is not limited to this. In this example, a sheet P for copying on which an image has been formed (printed) with the copy function, and a sheet P for printing on which an image has been formed (printed) with the printer function are discharged onto the discharge tray 14. The sheet P for copying and the sheet P for printing are sorted by the sheet sorting unit 300 and then are discharged onto the discharge tray 14.

The upper discharge tray 15 is disposed above the discharge tray 14 with the space SP in between, in the image forming unit 102 of the image forming apparatus main body 110. The sheets P on which the image has been formed (printed) are stacked face down on the upper discharge tray 15. The upper discharge tray 15 has a configuration similar to that of the discharge tray 14. More specifically, a placement surface 15*a*, on which the sheet P is placed, has an upstream side positioned lower than a downstream side in the conveyance direction Y3 of the sheet P. In this example, the sheet P for facsimile on which an image has been formed (printed) with the facsimile function is discharged onto the upper discharge tray 15. However, this should not be construed in a limiting sense.

The image forming apparatus main body 110 is provided with a sheet conveyance path S1 and an upper sheet conveyance path S2. In the sheet conveyance path S1, the sheet P transmitted from the paper feed trays 81 to 81 or the sheet feed device 200 is guided to the discharge tray 14 via the transfer roller 10 and the fixing unit 7. The upper sheet conveyance path S2, through which the sheet P is guided to the upper discharge tray 15, is branched upward from a branching portion S1*a* at a position between the fixing unit 7 and the discharge roller 31 of the sheet conveyance path S1. Pickup rollers 11*a* to 11*a* and 211*a*, a pair of feed rollers (11*b*, 11*c*) to (11*b*, 11*c*) and (211*b*, 211*c*), a plurality of conveyance rollers 12*a* to 12*a* and 12*b*, a registration roller 13, the transfer roller 10, a heat roller 71 and a pressure roller 72 in the fixing unit 7, and the discharge roller 31 are disposed near the sheet conveyance path S1.

An upper conveyance roller 12*c* and an upper discharge roller 36 are disposed near the upper sheet conveyance path S2. A branching claw G1 is disposed near the branching portion S1*a*. The branching claw G1 takes a first switch posture (a posture illustrated with a solid line in FIG. 2) with which the sheet P from the fixing unit 7 is guided to the discharge roller 31, and a second switch posture (a posture illustrated with a dotted line in FIG. 2) with which the sheet P from the fixing unit 7 is guided to the upper sheet conveyance path S2.

The upper discharge roller 36 rotates in a normal direction for discharging the sheet P onto the upper discharge tray 15 and rotates in a reverse direction for conveying the sheet P toward the opposite side of the conveyance direction Y3 (what is known as switchback). The image forming apparatus main body 110 is provided with a reversing sheet conveyance path S3 in which the sheet P from an upper branching portion S2*a* at an intermediate portion of the upper sheet conveyance path S2 is guided toward an upstream side of the registration roller 13 on the sheet conveyance path S1 while being reversed.

A plurality of (four in this example) reversing conveyance rollers 12*d* to 12*g* are disposed near the reversing sheet conveyance path S3. An upper branching claw G2 is disposed near the upper branching portion S2*a*. The upper branching claw G2 takes a first switched posture (a posture illustrated with a solid line in FIG. 2) with which the sheet P from the branching portion S1*a* is guided to the upper discharge roller 36, and a second switched posture (a posture illustrated with a dotted line in FIG. 2) with which the sheet P switched back from the upper discharge roller 36 is guided to the reversing sheet conveyance path S3.

The conveyance rollers 12*a* to 12*a*, and 12*b*, disposed along the sheet conveyance path S1, the upper conveyance roller 12*c*, disposed along the upper sheet conveyance path S2, and the reversing conveyance rollers 12*d* to 12*g*, disposed along the reversing sheet conveyance path S3, are small rollers facilitating and supporting the conveyance of the sheet P.

The pickup rollers 11*a* to 11*a* for the paper feed tray 81 are disposed near a sheet feed side of the paper feed trays 81 to 81, pick up the sheets P one by one from the paper feed trays 81 to 81, and feed the sheet P to the sheet conveyance path S1. The pair of feed rollers 11*b* to 11*b* and 11*c* to 11*c* feed the sheet P, transmitted thereto from the pickup rollers 11*a* to 11*a*, toward the sheet conveyance path S1.

Similarly, the pickup roller 211*a* in a sheet feed unit 210 of the sheet feed device 200 is disposed near a sheet feed side of the sheet feed device 200, picks up the sheets P one by one from the sheet feed device 200, and feeds the sheet P to the sheet conveyance path S1. The pair of feed rollers 211*b* and 211*c* feed the sheet P, transmitted thereto from the pickup roller 211*a*, toward the sheet conveyance path S1.

The registration roller 13 temporarily holds the sheet P, transmitted to the sheet conveyance path S1. Then, the registration roller 13 conveys the sheet P to a transfer nip portion between the transfer roller 10 and the intermediate transfer belt 61 in such a timing that leading edges of the toner images on the photosensitive drums 3 to 3 and a downstream side end (leading edge P1) of the sheet P in the conveyance direction Y3 match.

The fixing unit 7 fixes the unfixed toner image on the sheet P, and includes the heat roller 71 and the pressure roller 72 that serve as fixing rollers. The heat roller 71 is drivingly rotated to convey the sheet P nipped between the heat roller 71 and the pressure roller 72 that is driven to be rotated by the rotation of the heat roller 71. The heat roller 71 is heated by a heater 71*a* disposed on an inner side, and is maintained to be at a predetermined fixing temperature based on a signal from a temperature detector 71*b*. The heat roller 71 heated by the heater 71*a* cooperates with the pressure roller 72 to thermally press the multicolor toner image, which has been transferred on the sheet P, against the sheet P. Thus, the multicolor toner image is melted, mixed, and pressed and thus is thermally fixed on the sheet P.

Components with reference numerals not described with reference to FIG. 2 will be described later.

(Sheet Feed Device)

Next, the sheet feed device 200 illustrated in FIG. 1 and FIG. 2 is described below with reference to FIG. 3 to FIG. 10.

Figure 3:
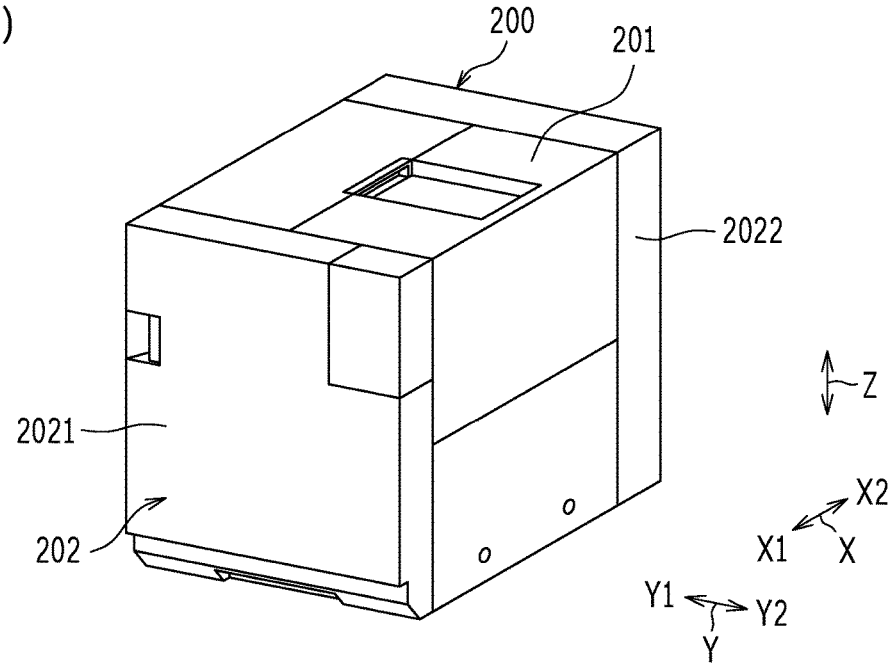
Figure 3:
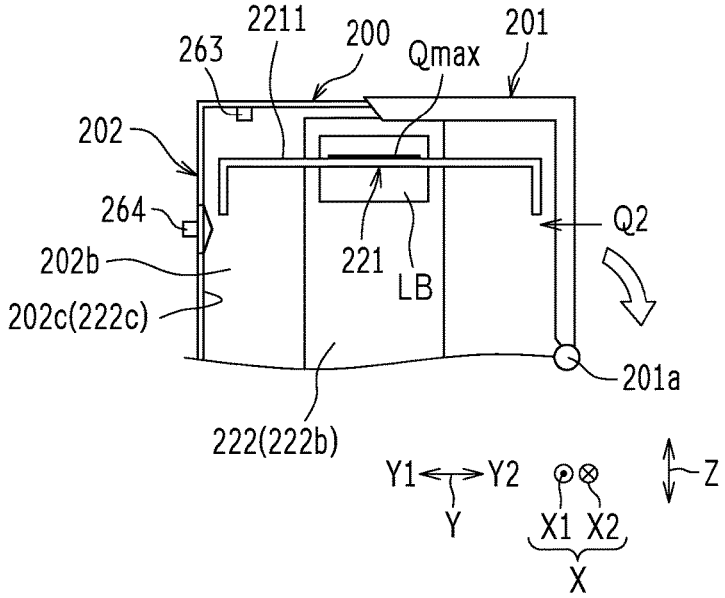
Figure 4:
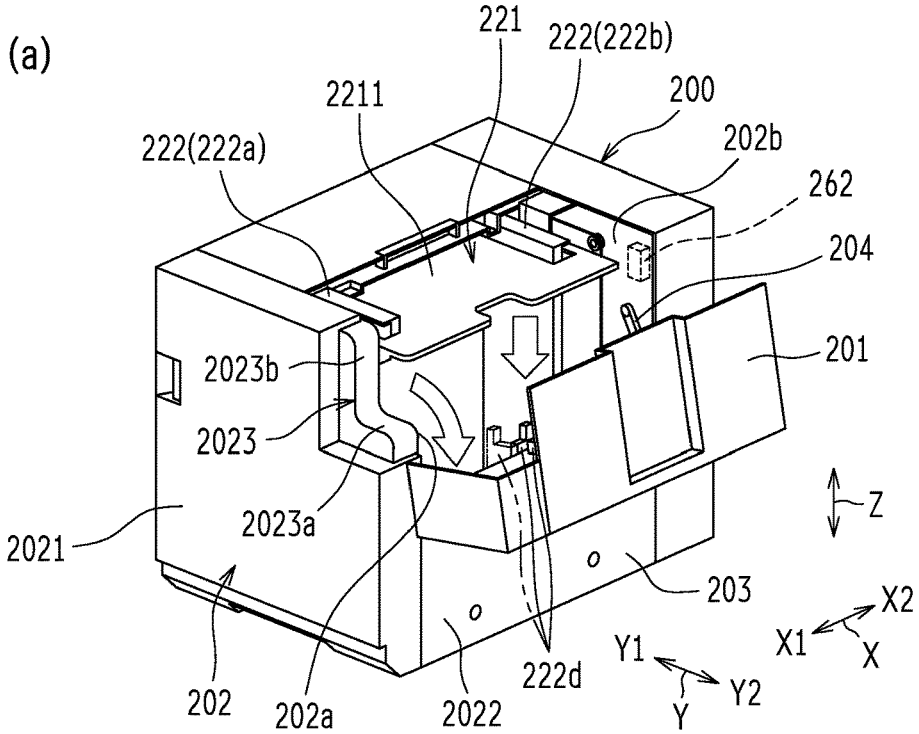
Figure 4:
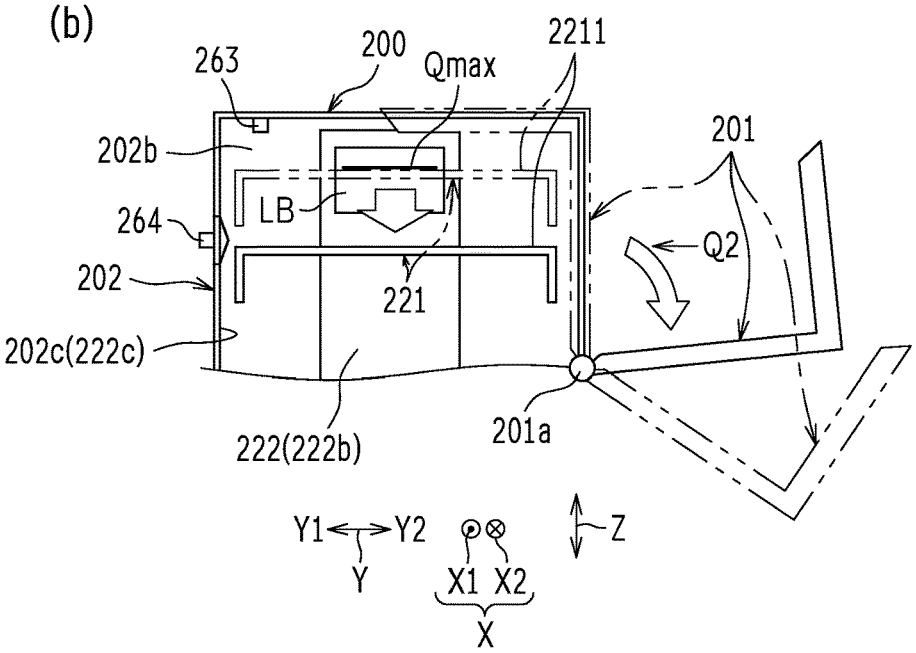
Figure 5:
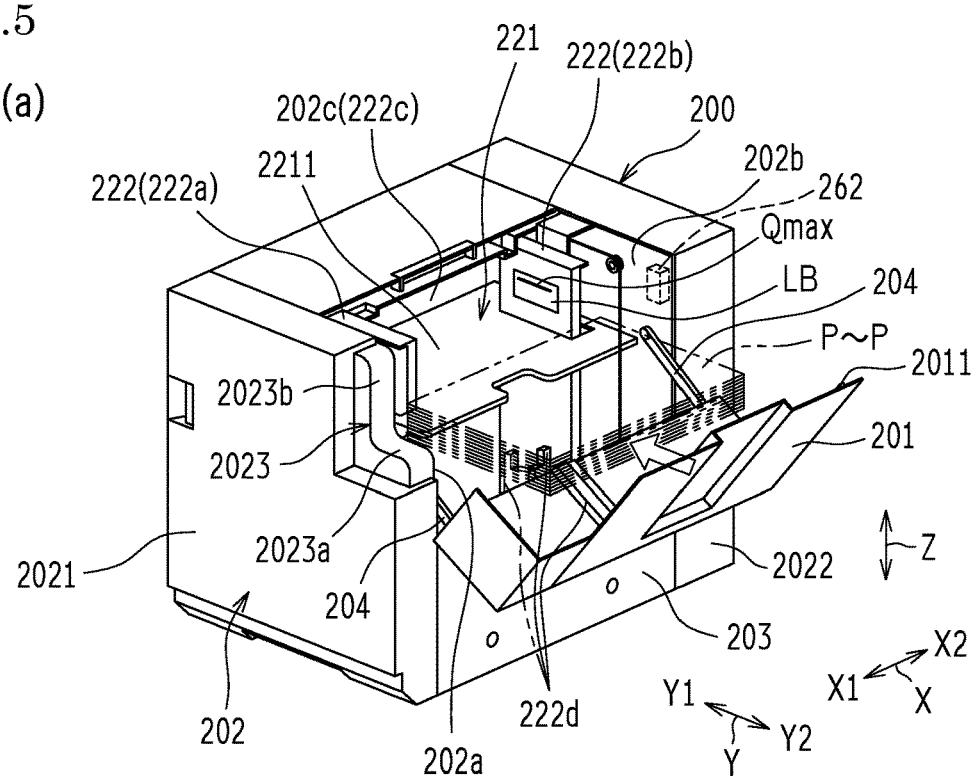
Figure 5:
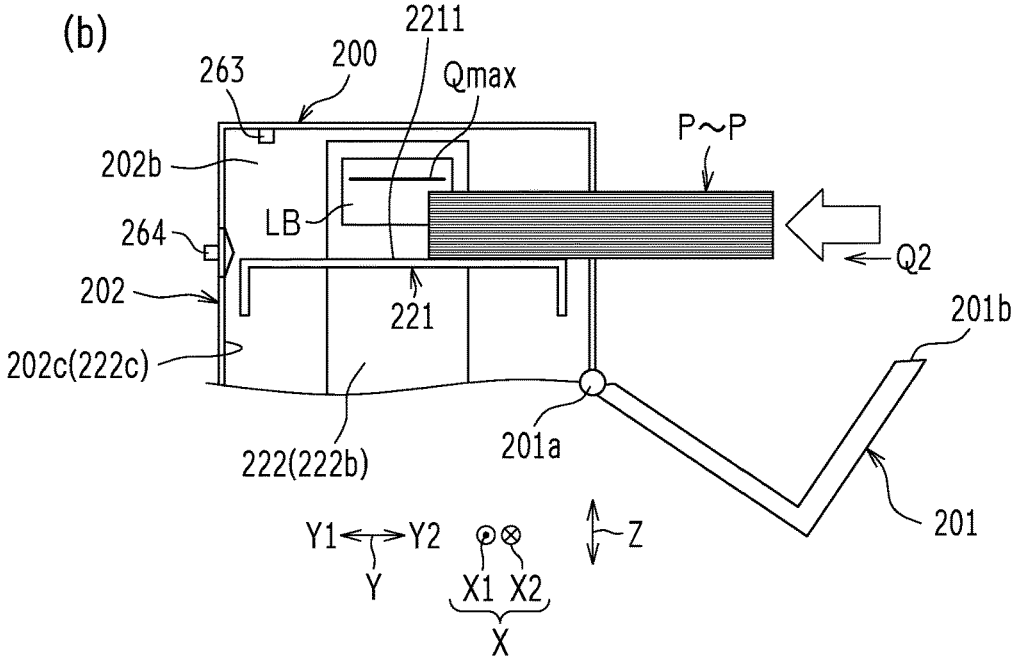

FIG. 3 to FIG. 5 are each a diagram illustrating a sheet supplying operation on the sheet feed device 200 illustrated in FIG. 1 and FIG. 2. FIG. 3A is a schematic perspective view illustrating a state where an openable cover 201 is closed. FIG. 3B is a schematic cross-sectional view schematically illustrating an internal configuration in the state where the openable cover 201 is closed. FIG. 4A is a schematic perspective view illustrating a state where the openable cover 201 is open. FIG. 4B is a schematic cross-sectional view schematically illustrating an internal configuration in the state where the openable cover 201 is open. FIG. 5A is a schematic perspective view illustrating a state where one bundle (a bundle of 500 sheets for example) of sheets P to P is supplied in the state where the openable cover 201 is open. FIG. 5B is a schematic cross-sectional view schematically illustrating an internal configuration in the state where the one bundle of sheets P to P is being supplied with the openable cover 201 open.

Figure 6:
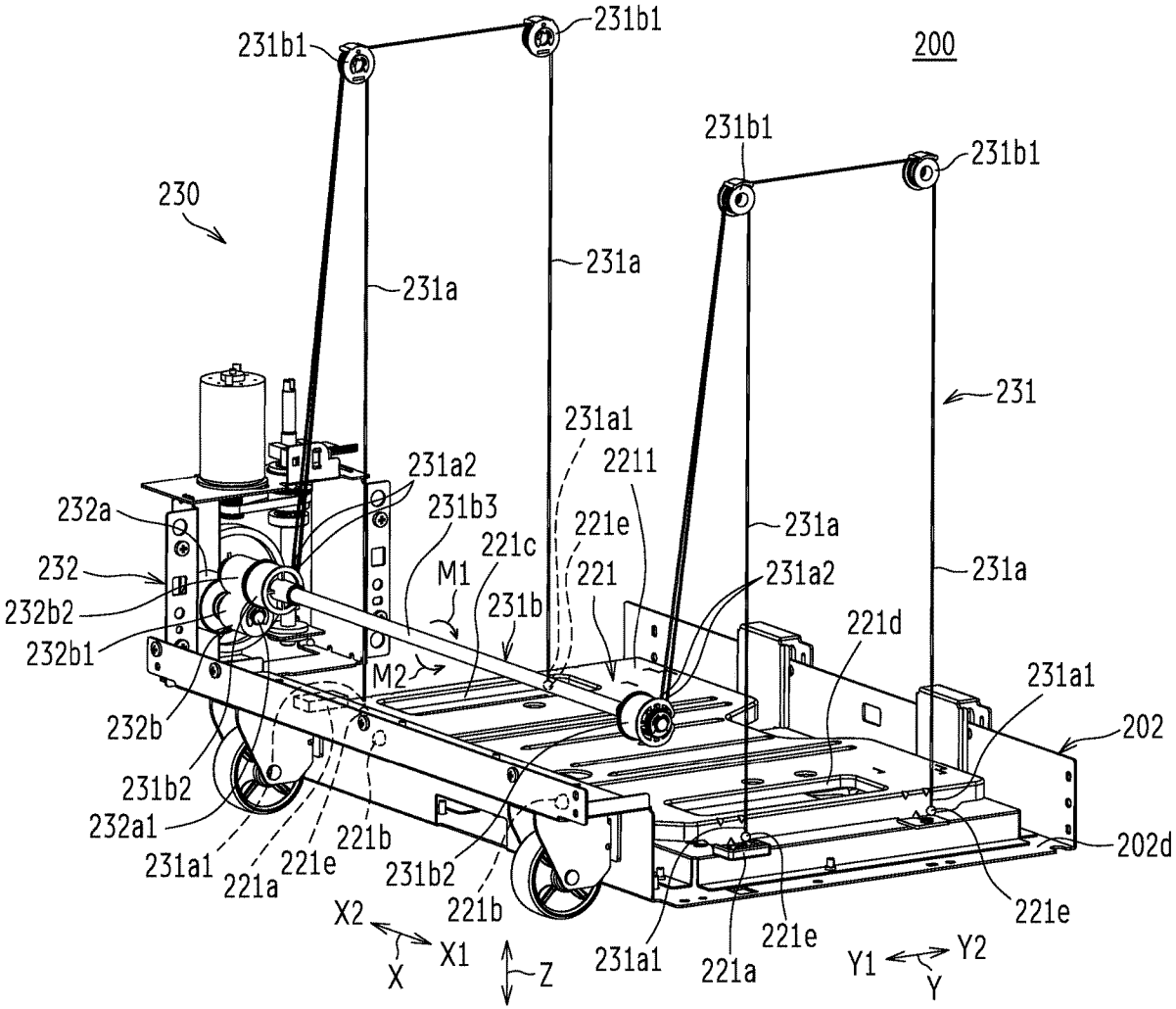
FIG. 6 is a schematic perspective view illustrating a schematic configuration of a stacking tray and a lifting/lowering device in the sheet feed device.

FIG. 6 is a schematic perspective view illustrating a schematic configuration of the stacking tray 221 and a lifting/lowering device 230 in the sheet feed device 200.

Figure 7:
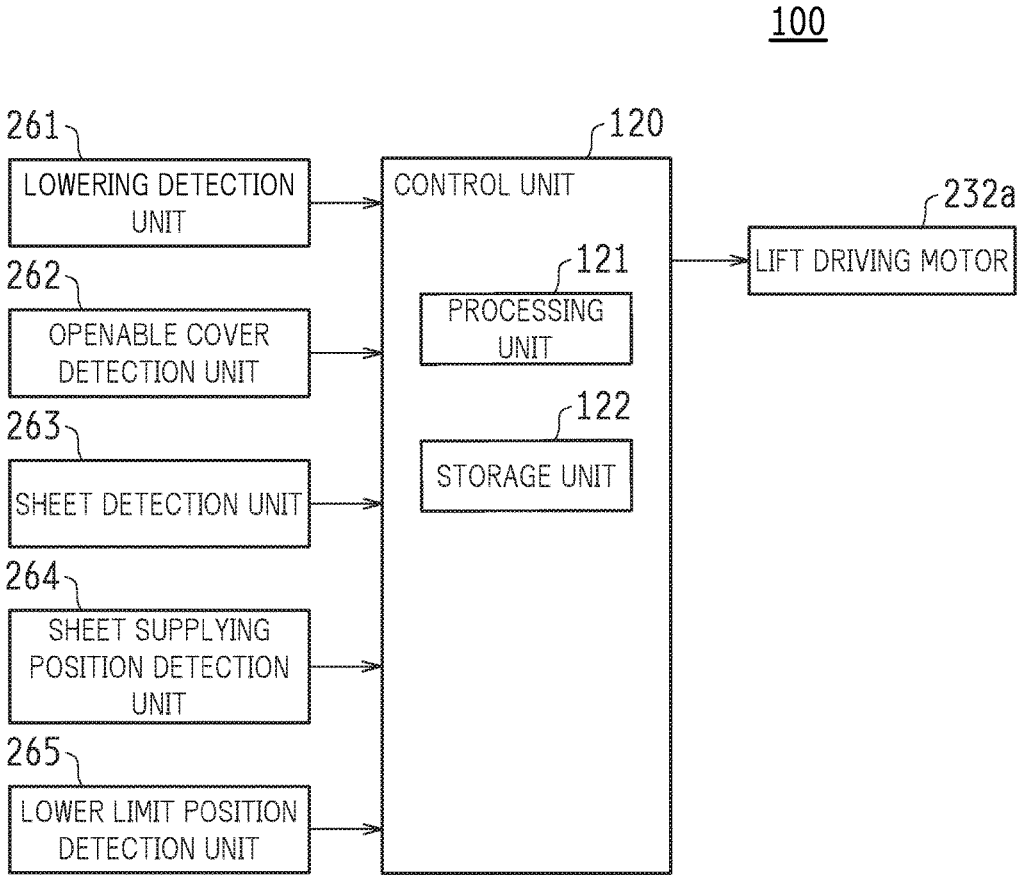
FIG. 7 is a block diagram illustrating a system configuration for performing a control operation on the sheet feed device with a control unit in the image forming apparatus.

FIG. 7 is a block diagram illustrating a system configuration for performing a control operation on the sheet feed device 200 with a control unit 120 in the image forming apparatus 100.

Figure 8:
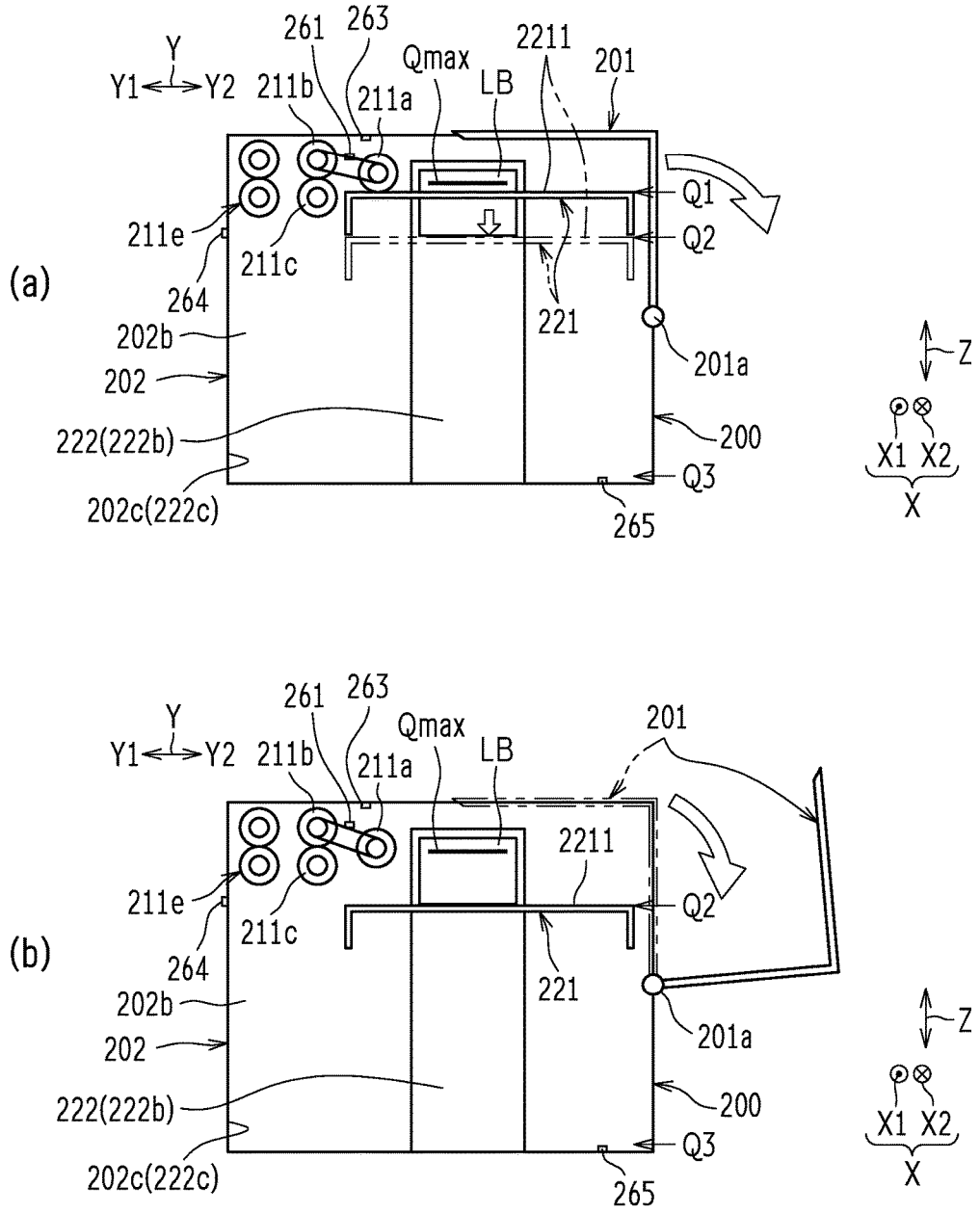
Figure 9:
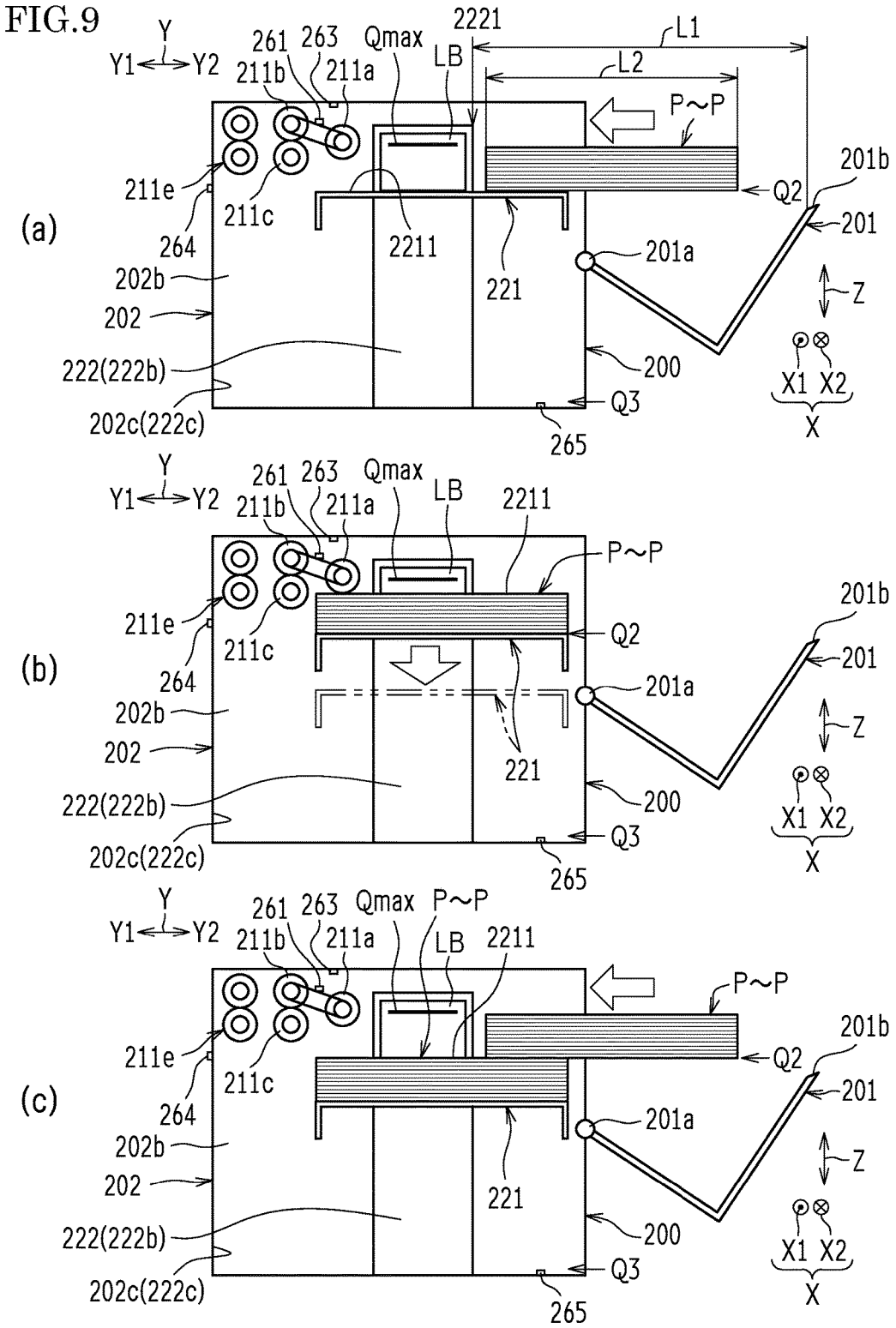

FIG. 8 and FIG. 9 are schematic cross-sectional views schematically illustrating lifted and lowered states of the stacking tray 221 achieved by the lifting/lowering device 230 in the sheet feed device 200. FIG. 8A illustrates a state where the openable cover 201 is closed with no sheet P on the stacking tray 221. FIG. 8B illustrates a state where the openable cover 201 is open. FIG. 9A illustrates a state where an operation of loading the one bundle of sheets P to P on the stacking tray 221 is in process. FIG. 9B illustrates a state where the operation of loading the one bundle of sheets P to P on the stacking tray 221 is completed. FIG. 9C illustrates a state where an operation of putting a next bundle of sheets P to P is in process, with the stacking tray 221 lowered.

Figure 10:
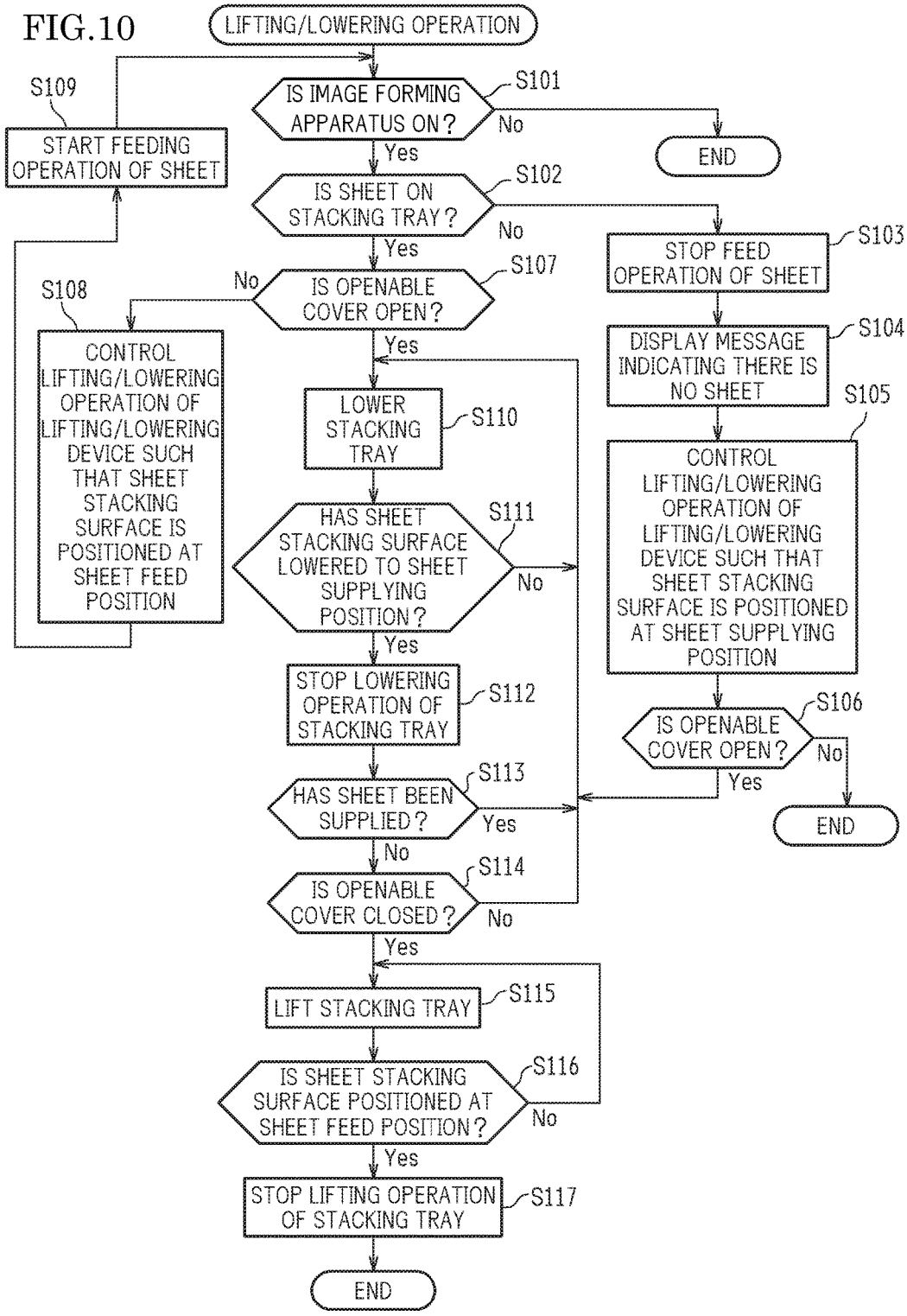
FIG. 10 is a flowchart illustrating an operation of lifting/lowering a lifting/lowering device by a control unit.

FIG. 10 is a flowchart illustrating an example of an operation of lifting/lowering the lifting/lowering device 230 by the control unit 120.

The sheet feed device 200 includes the stacking tray 221 (see FIG. 2, FIG. 3B, FIG. 4 to FIG. 6, FIG. 8, and FIG. 9), a casing 202 (see FIG. 3 to FIG. 6, FIG. 8, and FIG. 9), a position restricting member 222 (see FIG. 3B, FIG. 4, FIG. 5, FIG. 8, and FIG. 9), the openable cover 201 (see FIG. 3 to FIG. 5, FIG. 8, and FIG. 9) (an example of the openable member), the lifting/lowering device 230 (see FIG. 6) (an example of the lifting/lowering control unit), the pair of feed rollers 211*b* and 211*c* (see FIG. 2, FIG. 8, and FIG. 9) and a conveyance roller 211*e* (see FIG. 2, FIG. 8, and FIG. 9). A pair of supply rollers 211*b* and 211*c* may be a driving roller and a driven roller, or may both be the driving roller.

(Stacking Tray)

The stacking tray 221, on which the sheets P to P are stacked, is provided in the casing 202 in a liftable manner.

More specifically, the stacking tray 221 is provided in the casing 202 of the sheet feed device 200 in such a manner as to be movable back and forth along an upper and lower direction Z. The stacking tray 221 is a plate-shaped member extending along both predetermined depth direction X and left and right direction Y. The stacking tray 221 is a rectangular member with a longitudinal side extending in the depth direction X in plane view. The depth direction X is a direction between a front surface side (forward side, operation side) and a back surface side (rear side, side opposite to the operation side) of the sheet feed device 200. The left and right direction Y is orthogonal to both the depth direction X and the upper and lower direction Z. In this example, the depth direction X is orthogonal to a sheet feed direction Y1 of the sheets P to P stacked on the stacking tray 221, and extends along the sheet surface of the sheets P to P. The left and right direction Y extends along the sheet feed direction Y1 of the sheets P to P stacked on the stacking tray 221.

(Casing)

The casing 202 accommodates the stacking tray 221 in a liftable manner. The casing 202 has a front surface 2021 (see FIG. 3A, FIG. 4A, and FIG. 5A) as a predetermined surface in a direction orthogonal to the upper and lower direction Z (on one side in the depth direction X in this example). The sheets P to P are supplied from one side in the left and right direction Y, with respect to the front surface 2021 of the casing 202 (a side of an opposite direction Y2 with respect to the sheet feed direction Y1), that is, from a right side surface 2022 in this example (see FIG. 3A, FIG. 4A, and FIG. 5A).

More specifically, the casing 202 includes: a pair of inner walls 202*a* and 202*b* (see FIG. 3B, FIG. 4, FIG. 5, FIG. 8, and FIG. 9) arranged along both the left and right direction Y and the upper and lower direction Z with a predetermined distance provided in between; and a side wall 202*c* (FIG. 3B, FIG. 4B, FIG. 5, FIG. 8, and FIG. 9) provided on a feed side of the sheet P of the pair of inner walls 202*a* and 202*b* while extending along both the depth direction X and the upper and lower direction Z. The stacking tray 221 includes: a pair of sliding members 221*a* and 221*a* (see FIG. 6) that are provided on both ends in the depth direction X and slide on the pair of inner walls 202*a* and 202*b* of the casing 202, during the back and forth movement along the upper and lower direction Z; and a plurality of (two in this example) sliding members 221*b* to 221*b* (see FIG. 6) that are provided on one end on the feed side of the sheet P in the left and right direction Y, and slide on the side wall 202*c* of the casing 202, during the back and forth movement in the upper and lower direction Z. Thus, the stacking tray 221 can stably move back and forth along the upper and lower direction Z, with respect to the casing 202.

(Position Restricting Member)

The position restricting member 222 restricts positions of the sheets P to P stacked on the stacking tray 221.

More specifically, the position restricting member 222 includes a front surface side position restricting member 222*a* (see FIG. 4A and FIG. 5A) and a back surface side position restricting member 222*b* (see FIG. 3B, FIG. 4, FIG. 5, FIG. 8, and FIG. 9).

The front surface side position restricting member 222*a* and the back surface side position restricting member 222*b* restrict the positions of the sheets P to P, through restriction of movement of the sheets P to P, stacked on the stacking tray 221, toward a front surface side X1 and a back surface side X2 opposite to the front surface side X1.

The front surface side position restricting member 222*a* and the back surface side position restricting member 222*b* stand from a bottom surface 202*d* (see FIG. 6) of the casing 202 to extend in both the left and right direction Y and the upper and lower direction Z, while being separated from each other in the depth direction X by a predetermined distance (distance slight larger than the size of the sheet P in the depth direction X, due to a predetermined gap).

In this example, with the front surface side position restricting member 222*a* and the back surface side position restricting member 222*b*, the restricting position, in the depth direction X, can be adjusted for the sheet P of various sizes (more specifically, a A4 size, a letter size, and a B5 size).

More specifically, the casing 202 of the sheet feed device 200 is provided with fixing screw holes (not illustrated) and fixing engagement members (for example, engagement protrusions), for fixing the front surface side position restricting member 222*a* and the back surface side position restricting member 222*b*, arranged along the upper and lower direction Z. The front surface side position restricting member 222*a* and the back surface side position restricting member 222*b* are provided with a plurality of fixing screw through holes (not illustrated) that corresponding to the various sizes and are arranged in the depth direction X and fixing engagement members (for example, engagement holes) (not illustrated) that are arranged in the upper and lower direction Z. A fixing screw (not illustrated) is inserted in the fixing screw through hole corresponding to the size of the sheet P to be placed and screwed in the fixing screw hole, with the fixing screw through holes matching or substantially matching the fixing screw holes and with the fixing engagement member (for example, the engagement hole) corresponding to the size of the sheet P to be placed engaged with the fixing engagement member (for example, the engagement protrusion). In this manner, the restricting position in the depth direction X can be adjusted with the front surface side position restricting member 222*a* and the back surface side position restricting member 222*b*, in accordance with the size of the sheet P in the depth direction X.

The position restricting member 222 further includes a feed side position restricting member 222*c* (see FIG. 3B, FIG. 4B, FIG. 5, FIG. 8, and FIG. 9), and a supply side position restricting member 222*d* (see FIG. 4A and FIG. 5A).

The feed side position restricting member 222*c* and the supply side position restricting member 222*d* restrict the positions of the sheets P to P, through restriction of the movement of the sheets P to P, placed on the stacking tray 221, in the sheet feed direction Y1 and in the opposite direction Y2 opposite to the sheet feed direction Y1.

The feed side position restricting member 222*c* forms the side wall 202*c* provided on the feed side of the sheet P with respect to the pair of inner walls 202*a* and 202*b*. The supply side position restricting member 222*d* is provided in a center portion in the depth direction X while being split to be provided on the inner surface of the openable cover 201 and on the inner surface of a side cover 203 (see FIG. 4A and FIG. 5A).

In this example, the supply side position restricting members 222*d* and 222*d* are provided with the restricting position being adjustable on one side (the sheet feed direction Y1) in the left and right direction Y, in accordance with the sheet P of various sizes (more specifically, the A4 size and the B5 size).

More specifically, fixing screw holes (not illustrated), for fixing the supply side position restricting members 222*d* and 222*d*, are arranged on the inner surfaces of the openable cover 201 and the side cover 203 along the left and right direction Y. The supply side position restricting members 222*d* and 222*d* each have a rectangular parallelepiped shape as viewed in the upper and lower direction Z (in plane view). A fixing member (not illustrated), with which the supply side position restricting members 222*d* and 222*d* are fixed in a shorter side direction, is provided with shorter side direction fixing screw through holes (not illustrated) arranged along the shorter side direction as viewed in the upper and lower direction Z (in plane view). A fixing member (not illustrated), with which the supply side position restricting members 222*d* and 222*d* are fixed in a longitudinal direction, is provided with longitudinal direction fixing screw through holes (not illustrated) arranged along the longitudinal direction as viewed in the upper and lower direction Z (in plane view). When the sheet P of the maximum size is to be placed, fixing screws (not illustrated) are inserted in the shorter side direction fixing screw through holes and screwed in the fixing screw holes with the shorter side direction of the supply side position restricting members 222*d* and 222*d* oriented in left and right direction Y as viewed in the upper and lower direction Z (in plane view). When the sheet P smaller than the maximum size is to be placed, the fixing screws are inserted in the longitudinal direction fixing screw through holes and screwed in the fixing screw holes with the longitudinal direction of the supply side position restricting members 222*d* and 222*d* orientated in the left and right direction Y as viewed in the upper and lower direction Z (in plane view). In this manner, the restricting position in the left and right direction Y of the supply side position restricting members 222*d* and 222*d* can be adjusted in accordance with the size of the sheet P in the left and right direction Y.

The stacking tray 221 is provided with insertion holes 221*c* and 221*d* (see FIG. 6) through which the front surface side position restricting member 222*a* and the back surface side position restricting member 222*b* are inserted. The insertion holes 221*c* and 221*d* have a predetermined size in the left and right direction Y slightly larger than the size of the front surface side position restricting member 222*a* and the back surface side position restricting member 222*b* in the left and right direction Y (by a predetermined distance large enough to achieve smooth movement of the front surface side position restricting member 222*a* and the back surface side position restricting member 222*b* in the insertion holes 221*c* and 221*d*). The insertion holes 221*c* and 221*d* have a predetermined size in the depth direction X for adjusting positioning of the front surface side position restricting member 222*a* and the back surface side position restricting member 222*b* in the depth direction X.

(Openable Cover)

The openable cover 201 is provided to the casing 202 in an openable manner and faces the stacking tray 221. In this example, the openable cover 201 is provided to the casing 202 in an openable manner and covers the stacking tray 221 while being in a closed state. The openable cover 201 is not limited to this configuration of covering the stacking tray 221. For example, the openable cover 201 may be provided only on a side surface side of the stacking tray 221. If a frame member is provided inside the casing 202, the openable cover 201 may be openably provided to the frame member.

The openable cover 201 is provided to a side surface (in this example, the right side surface 2022) of the casing 202 on one side in the left and right direction Y. The openable cover 201 is supported by the casing 202 in an openable manner. The openable cover 201 can be opened and closed through rotation about a rotational axis along a restricting direction (in this example, the depth direction X) for restricting the position of the sheet P with the position restricting member 222 (in this example, the front surface side position restricting member 222*a* and the back surface side position restricting member 222*b*). In this example, the direction in which the openable cover 201 is opened and closed is the sheet feed direction Y1 of the sheet P.

More specifically, rotational shafts 201*a* and 201*a* (see FIG. 3B, FIG. 4B and FIG. 5B) protruding outward in the depth direction X are provided to both end portions of the openable cover 201 in the depth direction X. The rotational shafts 201*a* and 201*a* are rotatably inserted in rotation holes (not illustrated) provided to the pair of inner walls 202*a* and 202*b* of the casing 202. A pair of rotation restriction members 204 and 204 (see FIG. 4A and FIG. 5A) are provided between the openable cover 201 and the pair of inner walls 202*a* and 202*b* of the casing 202. The pair of rotation restriction members 204 and 204 prevent the openable cover 201 from rotating over a predetermined full open angle corresponding to a full open state of the openable cover 201. Thus, the full open state (see FIG. 5 and FIG. 9) is maintained with the rotation of the openable cover 201 over the full open angle prevented by the pair of rotation restriction members 204 and 204.

(Lifting/Lowering Device)

As illustrated in FIG. 6, the lifting/lowering device 230 lifts and lowers the stacking tray 221 in the casing 202. The lifting/lowering device 230 includes a lift mechanism 231 and a lift driving unit 232.

The lift mechanism 231 is configured to perform a lifting operation of lifting the stacking tray 221 and a lowering operation of lowering the stacking tray 221. The lift driving unit 232 drives the lift mechanism 231 to perform the lifting operation of the lift mechanism 231, and cancels the driving of the lift mechanism 231 so that the lift mechanism 231 is lowered with its own weight.

More specifically, the lift mechanism 231 includes: a plurality of (in this example, four) lift wires 231*a* to 231*a* with which the stacking tray 221 is suspended; and winding units 231*b* that wind the lift wires 231*a* to 231*a* with which the stacking tray 221 is suspended.

In this example, the lift wires 231*a* to 231*a* include pairs of lift wires (231*a*, 231*a*) and (231*a*, 231*a*) with one end portions 231*a*1 to 231*a*1 provided on both side surfaces of the stacking tray 221 in the depth direction X while being separated from each other by a predetermined distance in the left and right direction Y, in such a manner that the stacking tray 221 is horizontally or substantially horizontally balanced. The winding units 231*b* and 231*b* include: a pair of support pulleys 231*b*1 and 231*b*1 and a winding pulley 231*b*2 provided on the front surface side X1 in the depth direction X; and a pair of support pulleys 231*b*1 and 231*b*1 and the winding pulley 231*b*2 provided on the back surface side X2 in the depth direction X.

The pair of support pulleys (231*b*1, 231*b*1), provided on the front surface side X1 in the depth direction X, are rotatably provided to a pair of pivot shafts (not illustrated) provided to the casing 202 at positions above a pair of connection portions (221*e*, 221*e*) where the pair of lift wires (231*a*, 231*a*) on the front surface side X1 of the stacking tray 221 are connected. Similarly, the pair of support pulleys (231*b*1, 231*b*1), provided on the back surface side X2 in the depth direction X, are rotatably provided to the pair of pivot shafts (not illustrated) provided to the casing 202 at positions above the pair of connection portions (221*e*, 221*e*) where the pair of lift wires (231*a*, 231*a*) on the back surface side X2 of the stacking tray 221 are connected.

The winding pulley 231*b*2 provided on the front surface side X1 in the depth direction X can wind the pair of lift wires 231*a* and 231*a*, spanned by the pair of support pulleys 231*b*1 and 231*b*1 provided at above positions, with the one end portions 231*a*1 and 231*a*1 connected to the front surface side X1 of the stacking tray 221 and other end portions 231*a*2 and 231*a*2 connected to the winding pulley 231*b*2. Similarly, the winding pulley 231*b*2 provided on the back surface side X2 in the depth direction X can wind the pair of lift wires 231*a* and 231*a*, spanned by the pair of support pulleys 231*b*1 and 231*b*1 provided at above positions, with one end portions 231*a*1 and 231*a*1 connected to the back surface side X2 of the stacking tray 221 and the other end portions 231*a*2 and 231*a*2 connected to the winding pulley 231*b*2.

The two winding pulleys 231*b*2 and 231*b*2 provided on both sides in the depth direction X are fixed to a rotational shaft 231*b*3 rotatably disposed in the casing 202 along the depth direction X. The winding pulleys 231*b*2 and 231*b*2 rotate in a winding direction M1 (clockwise direction in FIG. 6) about the axis of the rotational shaft 231*b*3 to wind the pair of lift wires (231*a*, 231*a*) and (231*a*, 231*a*) on both sides in the depth direction X so that the stacking tray 221 can be lifted while maintaining its posture. The winding pulleys 231*b*2 and 231*b*2 rotate in a feed direction M2 (counter clockwise direction in FIG. 6), opposite to the winding direction M1, about the axis of the rotational shaft 231*b*3 to feed the pair of lift wires (231*a*, 231*a*) and (231*a*, 231*a*) on both sides in the depth direction X so that the stacking tray 221 can be lowered by its own weight while maintaining its posture.

The lift driving unit 232 includes a lift driving motor 232*a* and a lift driving force transmission mechanism 232*b*. The lift driving motor 232*a* is driven for performing the lifting/lowering operation of the lift mechanism 231. The lift driving force transmission mechanism 232*b* transmits a rotational driving force from the lift driving motor 232*a* to the lift mechanism 231.

More specifically, the lift driving motor 232*a* is provided on the back surface side X2 in the depth direction X, and is fixed to the casing 202 with a rotational shaft 232*a*1 extending toward the front surface side X1 in the depth direction X. The lift driving force transmission mechanism 232*b* is a gear train including a plurality of (in this example, two) gears 232*b*1 and 232*b*2.

More specifically, the two gears 232*b*1 and 232*b*2 are respectively fixed to the rotational shaft 232*a*1 of the lift driving motor 232*a* and to the rotational shaft 231*b*3 while meshing with the gear 232*b*1.

(Pair of Feed Rollers)

The pair of feed rollers 211*b* and 211*c* feed the sheets P stacked on the stacking tray 221, and lifted up to a predetermined sheet feed position Q1 (see FIG. 8A) by the lifting/lowering device 230, in the predetermined sheet feed direction Y1.

(Conveyance Roller)

The conveyance roller 211*e* is disposed further on the downstream side than the pair of feed rollers 211*b* and 211*c* in the sheet feed direction Y1, and feeds the sheet P, conveyed thereto by the pair of feed rollers 211*b* and 211*c*, to the image forming apparatus main body 110.

(Control Unit)

As illustrated in FIG. 7, the image forming apparatus 100 further includes the control unit 120 that is in charge of overall control of the image forming apparatus 100. The control unit 120 may be a component of the sheet feed device 200.

The control unit 120 is configured to control the lifting/lowering operation of the stacking tray 221 performed by the lifting/lowering device 230.

The control unit 120 includes: a processing unit 121 including a microcomputer such as a central processing unit (CPU); and a storage unit 122 including a nonvolatile memory such as a read only memory (ROM) and a volatile memory such as a random access memory (RAM). The control unit 120 controls operations of various components, with the processing unit 121 loading a control program, stored in the ROM of the storage unit 122 in advance, onto the RAM of the storage unit 122, and executing the control program. The RAM of the storage unit 122 provides a work area for performing an operation for the processing unit 121, and an area serving as an image memory storing therein image data.

The sheet feed device 200 includes: a lowering detection unit 261 (see FIG. 7 to FIG. 9); an openable cover detection unit 262 (see FIG. 4A, FIG. 5A and FIG. 7) (an example of the openable member detection unit); a sheet detection unit 263 (see FIG. 3B, FIG. 4B, FIG. 5B and FIG. 7 to FIG. 9); a sheet supplying position detection unit 264 (see FIG. 3B, FIG. 4B, FIG. 5B, FIG. 7 to FIG. 9); and a lower limit position detection unit 265 (see FIG. 7 to FIG. 9).

The lowering detection unit 261 detects the lowering operation of the stacking tray 221 from the sheet feed position Q1, more specifically, whether a sheet stacking surface 2211 (see FIG. 3B, FIG. 4 to FIG. 6, FIG. 8, and FIG. 9) of the stacking tray 221 is positioned at the sheet feed position Q1. The lowering detection unit 261 is electrically connected to an input system of the control unit 120. Thus, the control unit 120 can detect (recognize) the lowering operation of the stacking tray 221 from the sheet feed position Q1, that is, whether the sheet stacking surface 2211 is at the sheet feed position Q1, based on a detection signal from the lowering detection unit 261. In this example, the lowering detection unit 261 is a light transmitting detection switch, provided with an actuator, is disposed near the pickup roller 211*a*, and detects a lifting/lowering position of the pickup roller 211*a* about the axis of the first feed roller 211*b*.

The openable cover detection unit 262 detects an open/closed state of the openable cover 201, more specifically, whether the openable cover 201 is open. The openable cover detection unit 262 is electrically connected to the input system of the control unit 120. Thus, the control unit 120 can detect (recognize) the open/closed state of the openable cover 201, more specifically, whether the openable cover 201 is open. In this example, the openable cover detection unit 262 is a micro switch provided to the right side surface 2022 of the casing 202, and detects whether the openable cover 201 is open with a protrusion 2011 (see FIG. 5A) provided to the openable cover 201.

The sheet detection unit 263 detects whether the sheet P is on the stacking tray 221. The sheet detection unit 263 is electrically connected to the input system of the control unit 120. Thus, the control unit 120 can detect (recognize) the sheet P on the stacking tray 221 with a detection signal from the sheet detection unit 263. In this example, the sheet detection unit 263 is a light reflecting detection switch disposed at an upper position in the casing 202. The sheet detection unit 263 irradiates the sheet P on the stacking tray 221 (when there is the sheet P) or an upper surface of the stacking tray 221 (when there is not sheet P) with light, and detects reflected light from the sheet P on the stacking tray 221 (when there is the sheet P) or the upper surface of the stacking tray 221 (when there is not sheet P).

The sheet supplying position detection unit 264 detects whether the sheet stacking surface 2211 of the stacking tray 221 is above a predetermined sheet supplying position Q2 (see FIG. 3B, FIG. 4B, FIG. 5B, FIG. 8 and FIG. 9). The sheet supplying position detection unit 264 is electrically connected to the input system of the control unit 120. Thus, the control unit 120 can detect (recognize) whether the sheet stacking surface 2211 of the stacking tray 221 is above the sheet supplying position Q2 with a detection signal from the sheet supplying position detection unit 264. In this example, the sheet supplying position detection unit 264 is a light transmitting detection switch, provided with an actuator, positioned at a threshold position in the casing 202 for determining whether the sheet stacking surface 2211 is above or below the sheet supplying position Q2 of the casing 202. The sheet supplying position detection unit 264 detects whether the sheet stacking surface 2211 of the stacking tray 221 is above the threshold position. The sheet supplying position detection unit 264 may have a conventional configuration, and thus the detailed description thereof will be omitted herein.

The lower limit position detection unit 265 detects a lower limit position Q3 (see FIG. 8 and FIG. 9) of the stacking tray 221. The lower limit position detection unit 265 is electrically connected to the input system of the control unit 120. Thus, the control unit 120 can detect (recognize) the lower limit position Q3 of the stacking tray 221 with a detection signal from the lower limit position detection unit 265. In this example, the lower limit position detection unit 265 is a light transmitting detection switch, provided with an actuator, disposed on the bottom surface of the casing 202. The lower limit position detection unit 265 detects whether the stacking tray 221 has reached the lower limit position Q3.

The sheet feed device 200 has a sheet stacking upper limit position Qmax (see FIG. 3B, FIG. 4B, FIG. 5B, FIG. 8 and FIG. 9) displayed thereon. The sheet stacking upper limit position Qmax represents a warning indicating that the sheets P to P exceeding the maximum stacked amount cannot be stacked on the stacking tray 221. In this example, a label LB indicating the sheet stacking upper limit position Qmax (see FIG. 3B, FIG. 4B, FIG. 5B, FIG. 8 and FIG. 9) is attached on the inner side surface of the back surface side position restricting member 222*b*.

[Configuration of First Embodiment]

The sheet feed device 200 has a configuration in which when the openable cover 201 is open, the sheet stacking surface 2211 on which the sheets P are stacked is positioned higher than a highest portion (hereinafter referred to as an uppermost portion) of the openable cover 201 in the upper and lower direction Z of the sheet feed device 200. More specifically, in the sheet feed device 200, when the openable cover 201 is open (a full open state in this example), the sheet stacking surface 2211 on which the sheets P are stacked is positioned higher than an uppermost portion 201*b* (in this example, a distal end portion of the openable cover 201 having a L-shaped cross-sectional shape) of the openable cover 201 in the upper and lower direction Z (see FIG. 5B and FIG. 9). In this state where the openable cover 201 is open (the full open state in this example), the sheet stacking surface 2211 is positioned at a sheet supplying position Q2 at which the sheets P are supplied.

The sheet stacking surface 2211 is the upper surface of the stacking tray 221 with no sheet P stacked thereon (see FIG. 3B, FIG. 4B, FIG. 5B, FIG. 8 and FIG. 9A). The sheet stacking surface 2211 is also the upper surface of the uppermost one of the sheets P stacked on the stacking tray 221 (see FIG. 9B and FIG. 9C).

As illustrated in FIG. 7, the lift driving motor 232*a* is electrically connected to an output system of the control unit 120, and thus the operation of the lift driving motor 232*a* is controlled with a control signal from the control unit 120.

First Embodiment-1

The control unit 120 is configured to control the lifting/lowering operation for the stacking tray 221 with the lifting/lowering device 230 in such a manner that the sheet stacking surface 2211 is positioned at an upper position higher than the predetermined sheet supplying position Q2 when the detection by the openable cover detection unit 262 indicates that the openable cover 201 is closed. The upper position is a position between the sheet supplying position Q2 and the sheet stacking upper limit position Qmax. In this example, the upper position is the sheet feed position Q1. The control unit 120 is configured to control the lifting/lowering operation for the stacking tray 221 with the lifting/lowering device 230 in such a manner that the sheet stacking surface 2211 is positioned at the sheet feed position Q1, based on the detection by the lowering detection unit 261.

First Embodiment-2

Upon detecting the presence of the sheet P on the stacking tray 221 based on the detection by the sheet detection unit 263 and detecting closing of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is positioned at the upper position (in this example, the sheet feed position Q1).

First Embodiment-3

Upon detecting opening of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is lowered from the upper position (in this example, the sheet feed position Q1) to be positioned at the sheet supplying position Q2, based on the detection by the based on the detection by the sheet supplying position detection unit 264.

First Embodiment-4

Upon detecting the absence of the sheet P on the stacking tray 221 based on the detection of the sheet detection unit 263 and detecting the closing of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is positioned at the sheet supplying position Q2 based on the detection by the sheet supplying position detection unit 264.

First Embodiment-5

Upon detecting the opening of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is maintained at the sheet supplying position Q2 based on the detection by the sheet supplying position detection unit 264.

First Embodiment-6

Upon detecting the absence of the sheet P on the stacking tray 221 based on the detection by the sheet detection unit 263 and detecting the closing of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is positioned at a lower position lower than the sheet supplying position Q2. The lower position is a position between the sheet supplying position Q2 and the lower limit position Q3. For example, the lower position may be the lower limit position Q3. The control unit 120 may control the lifting/lowering operation for the stacking tray 221 with the lifting/lowering device 230 in such a manner that the stacking tray 221 is positioned at the lower limit position Q3 based on the detection by the lower limit position detection unit 265.

First Embodiment-7

Upon detecting the opening of the openable cover 201 based on the detection by the openable cover detection unit 262, the control unit 120 is configured to control the lifting/lowering operation for the stacking tray 221 with the lifting/lowering device 230 in such a manner that the sheet stacking surface 2211 is lifted from the lower position (for example, the lower limit position Q3) to be positioned at the sheet supplying position Q2 based on the detection by the sheet supplying position detection unit 264.

First Embodiment-8

Upon detecting that the sheet stacking surface 2211 is higher than the sheet supplying position Q2 based on the detection by the sheet supplying position detection unit 264, the control unit 120 is configured to perform a lowering operation for the stacking tray 221 with the lifting/lowering device 230. Upon detecting that the sheet stacking surface 2211 has lowered from the sheet supplying position Q2 based on the detection by the sheet supplying position detection unit 264, the control unit 120 is configured to stop the lowering operation for the stacking tray 221 with the lifting/lowering device 230.

(Example of Controlling Lifting/Lowering Operation of Lifting/Lowering Device)

Next, an example of controlling the lifting/lowering operation of the lifting/lowering device 230 performed by the control unit 120 is described below with reference to FIG. 8 to FIG. 10.

As illustrated in FIG. 10, the lifting/lowering device 230 performs the lifting/lowering operation in the following manner. First of all, when the image forming apparatus 100 is ON (step S101: Yes), the control unit 120 determines whether the sheet P is on the stacking tray 221, based on the detection by the sheet detection unit 263 (step S102). When it is determined that there is no sheet P on the stacking tray 221 (step S102: No), the feed operation of the sheet P is stopped (step S103), and a message indicating that there is no sheet is displayed (step S104). The control unit 120 controls the lifting/lowering operation of the lifting/lowering device 230 in such a manner that the sheet stacking surface 2211 is positioned at the sheet supplying position Q2, with the sheet supplying position detection unit 264 (step S105) (see FIG. 8A), and determines whether the openable cover 201 is open based on the detection by the openable cover detection unit 262 (step S106). When the control unit 120 determines that the openable cover 201 is open (step S106: Yes), the processing proceeds to step S110 (see FIG. 8B).

Upon determining that there is the sheet P on the stacking tray 221 (step S102: Yes), the control unit 120 determines whether the openable cover 201 is open, based on the detection by the openable cover detection unit 262 (step S107). Upon determining that the openable cover 201 is closed (step S107: No), the control unit 120 controls the lifting/lowering operation of the lifting/lowering device 230 in such a manner that the sheet stacking surface 2211 is positioned at the sheet feed position Q1 based on the detection by the lowering detection unit 261 (step S108), and starts the feeding operation of the sheet P (step S109). Then, the processing proceeds to step S101. When the control unit 120 determines that the openable cover 201 is open (step S107: Yes), the processing proceeds to step S110.

Next, the control unit 120 causes the lifting/lowering device 230 to lower the stacking tray 221 (step S110), and detects whether the sheet stacking surface 2211 has lowered to the sheet supplying position Q2 based on the detection by the sheet supplying position detection unit 264 (step S111). When the control unit 120 determines that the sheet stacking surface 2211 has not lowered to the sheet supplying position Q2 (step S111: No), the processing proceeds to step S110 (see FIG. 9A and FIG. 9C). Upon determining that the sheet stacking surface 2211 has lowered to the sheet supplying position Q2 (step S111: Yes), the control unit 120 stops the lowering operation of the stacking tray 221 performed by the lifting/lowering device 230 (step S112).

Next, the control unit 120 determines whether the sheet P has been supplied (step S113). When the control unit 120 determines that the sheet P has been supplied (step S113: Yes), the processing proceeds to step S110. When the control unit 120 determines that the sheet P has not been supplied (step S113: No), the processing proceeds to step S114.

Next, the control unit 120 determines whether the openable cover 201 is closed based on the detection by the openable cover detection unit 262 (step S114). When the control unit 120 determines that the openable cover 201 is open (step S114: No), the processing proceeds to step S110. Upon determining that the openable cover 201 is closed (step S114: Yes), the control unit 120 causes the lifting/lowering device 230 to lift the stacking tray 221 (step S115).

Next, the control unit 120 determines whether the sheet stacking surface 2211 is positioned at the sheet feed position Q1 based on the detection by the sheet supplying position detection unit 264 (step S116). When the sheet stacking surface 2211 is not positioned at the sheet feed position Q1 (step S116: No), the processing proceeds to step S115. When the sheet stacking surface 2211 is positioned at the sheet feed position Q1 (step S116: Yes), the control unit 120 stops the lifting operation of the stacking tray 221 by the lifting/lowering device 230 (step S117).

The control unit 120 terminates the processing when the image forming apparatus 100 is turned OFF (step S101: No).

In the example of the control illustrated in FIG. 10, the lifting/lowering operation of the stacking tray 221 is controlled in such a manner that the sheet stacking surface 2211 is positioned at the sheet supplying position Q2, when the openable cover 201 is closed with no sheet P on the stacking tray 221. Alternatively, the lifting/lowering operation of the stacking tray 221 may be controlled in such a manner that the sheet stacking surface 2211 is maintained at the sheet feed position Q1 or is positioned at a position below the sheet supplying position Q2 (for example, the lower limit position Q3). When the sheet stacking surface 2211 is maintained to be at the sheet feed position Q1, the lifting/lowering operation of the stacking tray 221 may be controlled in such a manner that the sheet stacking surface 2211 is lowered from the sheet feed position Q1 to the sheet supplying position Q2 in response to the opening of the openable cover 201. When the sheet stacking surface 2211 is positioned at a lower position below the sheet supplying position Q2, the lifting/lowering operation of the stacking tray 221 may be controlled in such a manner that the sheet stacking surface 2211 is lifted from the lower position (for example, the lower limit position Q3) to be positioned at the sheet supplying position Q2 in response to the opening of the openable cover 201.

[Configuration of Second Embodiment]

The sheet feed device 200 includes: the openable cover 201 configured to be openable and closable in such a manner that the sheet P is supplied from one side in the left and right direction Y; and the casing 202 that accommodates the stacking tray 221. The casing 202 has the front surface 2021 with the one side partially notched to have a notched portion 2023. More specifically, the sheet feed device 200 has the casing 202 having one side (in the opposite direction Y2 with respect to the sheet feed direction Y1) (the right side surface 2022 in this example) of the front surface 2021 in the left and right direction Y, notched to have the notched portion 2023 (see FIG. 4A and FIG. 5A).

Second Embodiment-1

The notched portion 2023 is provided at a corner portion between an upper edge 2023*a* of the front surface 2021 (see FIG. 4A and FIG. 5A) of the casing 202 and a side edge 2023*b* on the one side (more specifically, on one side in the left and right direction Y) (in this example, a right side surface 2022) (see FIG. 4A and FIG. 5A). In this example, the notched portion 2023 with a right angle or a substantially right angle is provided between the upper edge 2023*a* and the side edge 2023*b*.

Second Embodiment-2

In the sheet feed device 200, the openable cover 201 in the closed state covers the notched portion 2023 (see FIG. 3A). Thus, the openable cover 201 in the closed state hides the notched portion 2023.

Second Embodiment-3

The notched portion 2023 also serves as an opening portion through which the back surface side position restricting member 222*b* can be visually recognized. More specifically, the notched portion 2023 is formed by notching the casing 202 by an amount large enough to allow visual recognition of the back surface side position restricting member 222*b* and the stacked state of the sheets P to P on the stacking tray 221 through the notched portion 2023 when the casing 202 is viewed from the front surface with the openable cover 201 open (the full open state in this example).

[Configuration of Third Embodiment]

In the sheet feed device 200, the position restricting member 222 and the openable cover 201 are configured in the following manner. More specifically, when the openable cover 201 is open, a distance L1 (see FIG. 9A) larger than a size L2 (see FIG. 9A) of the sheet P is provided between an end portion 2221 (see FIG. 9A) of the position restricting member 222 on a side of the openable cover and the uppermost portion 201*b* of the openable cover 201 (more specifically, the openable cover 201 in the open state) in the upper and lower direction Z.

More specifically, when the openable cover 201 is open, the distance L1 (see FIG. 9A) between the end portion 2221 (see FIG. 9A) and the uppermost portion 201*b* in an orthogonal direction (in this example, the left and right direction Y) as a direction, along the sheet surface of the sheet P, orthogonal to the restricting direction (in this example, the depth direction X) is larger than the size L2 (see FIG. 9A) of the sheets P (the sheet P with the largest size in this example) stacked on the stacking tray 221 in the orthogonal direction (in this example, the left and right direction Y). The end portion 2221 (see FIG. 9A) is on the openable cover side of the position restricting member 222 in the orthogonal direction (in this example, left and right direction Y). The uppermost portion 201*b* (in this example, a distal end portion of an L shape in a cross-sectional view) is at the uppermost portion of the openable cover 201 in the opened state (in this example, the full open state) in the upper and lower direction Z.

[Configuration of Fourth Embodiment]

In the sheet feed device 200, the openable cover 201 is opened and closed in the sheet feed direction Y1 in which the sheet P is fed.

DESCRIPTION ON EMBODIMENTS

First Embodiment

In the first embodiment, when the openable cover 201 is open, the sheet stacking surface 2211, on which the sheets P are stacked, is positioned higher than the uppermost portion 201*b* of the openable cover 201 in the upper and lower direction Z. With the sheet stacking surface 2211 thus being positioned above the uppermost portion 201*b* of the openable cover 201, the uppermost portion 201*b* of the openable cover 201 is less likely to hinder the supplying operation of the sheet P. Thus, a higher operability of the sheet supplying operation for supplying the sheet P can be achieved.

In the first embodiment, the sheet stacking surface 2211 may be the upper surface of the stacking tray 221 in a state where no sheet P is on the stacking tray 221. In this case, the sheets P can be certainly stacked on the stacking tray 221 with no sheet P stacked thereon, whereby a higher operability of the sheet supplying operation can be achieved.

In the first embodiment, the sheet stacking surface 2211 may be the upper surface of the uppermost one of the sheets P stacked on the stacking tray 221. In this case, the sheets P can be certainly stacked on the sheets P on the stacking tray 221, whereby a higher operability of the sheet supplying operation can be achieved.

In the first embodiment-1, when the closing of the openable cover 201 is detected based on the detection by the openable cover detection unit 262, the lifting/lowering operation for the stacking tray 221 is controlled by the lifting/lowering device 230 in such a manner that the sheet stacking surface 2211 is positioned at the upper position higher than the sheet supplying position Q2. For example, the upper portion may be the sheet feed position Q1 at which the sheet P is fed. Thus, swift transition to the feeding operation of the sheet P can be achieved after the sheet P is supplied, with a sheet supplying space for supplying the sheet P ensured between the sheet feed position Q1 and the sheet supplying position Q2.

In the first embodiment-2, when the presence of the sheet P on the stacking tray 221 is detected by the sheet detection unit 263 and the closing of the openable cover 201 is detected by the openable cover detection unit 262, the lifting/lowering operation for the stacking tray 221 is controlled by the lifting/lowering device 230 in such a manner that the sheet stacking surface 2211 is positioned at the upper position higher than the sheet supplying position Q2. Generally, when the openable cover 201 is closed with the sheets P stacked on the stacking tray 221, the sheet P is expected to be fed. Thus, when the openable cover 201 is closed with the sheets P stacked on the stacking tray 221, the sheet stacking surface 2211 is positioned at the upper position (for example, the sheet feed position Q1) to prepare for the feeding of the sheet P. Thus, swift feeding of the sheets P can be achieved.

In the first embodiment-3, when the opening of the openable cover 201 is detected by the openable cover detection unit 262, the lifting/lowering operation for the stacking tray 221 is controlled by the lifting/lowering device 230 in such a manner that the sheet stacking surface 2211 is lowered from the upper position to be positioned at the sheet supplying position Q2. Thus, when the sheet stacking surface 2211 is positioned at the upper position higher than the sheet supplying position Q2 at the point when the openable cover 201 is closed, the sheet stacking surface 2211 can be lowered from the upper position to the sheet supplying position Q2 at the point of supplying the sheets P to P. Thus, the sheets P can be smoothly stacked on the stacking tray 221, whereby a higher operability of the sheet supplying operation can be achieved.

When the openable cover 201 is closed with no sheets P on the stacking tray 221, the sheet stacking surface 2211 does not necessarily need to be positioned at the upper position (for example, the sheet feed position Q1) higher than the sheet supplying position Q2. When the sheet stacking surface 2211 is positioned at the upper position (for example, the sheet feed position Q1), an unnecessary operation is performed for operating the lifting/lowering device 230 in such a manner that the sheet stacking surface 2211 is lowered from the upper position in response to the opening of the openable cover 201 for supplying the sheets P to P. Thus, the sheet stacking surface 2211 is preferably positioned at the sheet supplying position Q2 to prepare for the supplying of the sheets P.

In view of this, in the first embodiment-4, when the absence of the sheet P on the stacking tray 221 is detected by the sheet detection unit 263 and the closing of the openable cover 201 is detected by the openable cover detection unit 262, the lifting/lowering operation for the stacking tray 221 is controlled by the lifting/lowering device 230 in such a manner that the sheet stacking surface 2211 is positioned at the sheet supplying position Q2. As described above, the sheet stacking surface 2211 does not necessarily need to be positioned at the upper position (for example, the sheet feed position Q1) above the sheet supplying position Q2. With the configuration described above, an unnecessary operation for operating the lifting/lowering device 230 in such a manner that the sheet stacking surface 2211 is lowered from the upper position in response to the opening of the openable cover 201 for supplying the sheets P to P can be omitted. All things considered, the sheet stacking surface 2211 can be positioned at the sheet supplying position Q2 to prepare for the supplying of the sheets P.

In the first embodiment-5, when the opening of the openable cover 201 is detected by the openable cover detection unit 262, the lifting/lowering operation for the stacking tray 221 is controlled by the lifting/lowering device 230 in such a manner that the sheet stacking surface 2211 is maintained at the sheet supplying position Q2. Thus, the sheet stacking surface 2211 can be maintained at the sheet supplying position Q2 when the sheets P to P are supplied. Thus, the sheets P to P can be smoothly stacked on the stacking tray 221 without waiting for the lifting/lowering operation for the stacking tray 221 for moving the sheet stacking surface 2211 to the sheet supplying position Q2. Thus, a higher operability of the sheet supplying operation can be achieved.

When the openable cover 201 is closed with no sheet P on the stacking tray 221, the sheet stacking surface 2211 is positioned at or higher than the sheet supplying position Q2 with electric power supplied to the lifting/lowering device 230. This electric power supplied to the lifting/lowering device 230 is wastefully consumed. Thus, the electric power supply to the lifting/lowering device 230 is stopped when there is no sheet P on the stacking tray 221 to prevent the power consumption by the lifting/lowering device 230.

In view of this, in the first embodiment-6, when the absence of the sheet P on the stacking tray 221 is detected by the sheet detection unit 263 and the closing of the openable cover 201 is detected by the openable cover detection unit 262, the lifting/lowering operation for the stacking tray 221 is controlled by the lifting/lowering device 230 in such a manner that the sheet stacking surface 2211 is positioned at a lower position (for example, the lower limit position Q3) lower than the predetermined sheet supplying position Q2. As described above, the sheet stacking surface 2211 needs not to be positioned at or higher than the sheet supplying position Q2 when there is no sheet P on the stacking tray 221, and the electric power supplied to the lifting/lowering device 230 can be stopped. With the electric power supplied to the lifting/lowering device 230 stopped, the electric power consumption by the lifting/lowering device 230 can be prevented when there is no sheet P on the stacking tray 221.

In the first embodiment-7, when the opening of the openable cover 201 is detected by the openable cover detection unit 262, the lifting/lowering operation for the stacking tray 221 is controlled by the lifting/lowering device 230 in such a manner that the sheet stacking surface 2211 is lifted from the lower position (for example, the lower limit position Q3) to be positioned at the sheet supplying position Q2. Thus, when the openable cover 201 is closed with no sheet P on the stacking tray 221, the sheet stacking surface 2211 positioned at the lower position lower than the sheet supplying position Q2 can be lifted from the lower position to the sheet supplying position Q2 when the sheets P to P are supplied. Thus, the sheets P can be smoothly stacked on the stacking tray 221, whereby a higher operability of the sheet supplying operation can be achieved.

The sheets P to P may be stacked and supplied by the user with the sheet stacking surface 2211 positioned at the sheet supplying position Q2. In this case, the sheet stacking surface 2211 is positioned higher the sheet supplying position Q2, and thus the amount of sheets P to P that can be stacked and supplied on the sheet stacking surface 2211 is limited, and a large amount of sheets P to P cannot be stacked. Thus, the sheet stacking surface 2211 is positioned at the sheet supplying position Q2 each time the sheets P to P are stacked and supplied on the sheet stacking surface, so that a large amount of sheets P to P can be stacked.

In view of this, in the first embodiment-8, when the sheet stacking surface 2211 is detected to be higher than the sheet supplying position Q2 by the sheet supplying position detection unit 264, the lower operation for the stacking tray 221 is performed by the lifting/lowering device 230. When the sheet stacking surface 2211 is detected to become not higher than the sheet supplying position Q2 by the sheet supplying position detection unit 264, the lowering operation for the stacking tray 221 is stopped by the lifting/lowering device 230. Thus, when the user stacks and supplies the sheets P to P on the sheet stacking surface 2211 positioned at the sheet supplying position Q2, the sheets P to P can be stacked downward from the sheet supplying position Q2 with the sheet stacking surface 2211 maintained at the sheet supplying position Q2. All things considered, a large amount of sheets P to P can be stacked with the sheet stacking surface 2211 positioned at the sheet supplying position Q2 each time the sheets P to P are stacked and supplied on the sheet stacking surface 2211.

Second Embodiment

In the second embodiment, the casing 202 has the front surface 2021 with the one side partially notched to have the notched portion 2023 serving as a space for supplying the sheets P to P. Thus, the front surface 2021 of the casing 202 is less likely to hinder the supplying of the sheets P to P (especially, the supplying of the sheets P to P from the front surface 2021). Thus, a higher operability of the sheet supplying operation for supplying the sheets P to P can be achieved.

When the openable cover 201 is disposed on the side surface of the casing 202 on one side in the left and right direction Y, the supplying of the sheets P to P (especially, the supplying of the sheets P to P from the front surface 2021) is hindered by the corner portion between the upper edge of the front surface 2021 of the casing 202 and the side edge on one side in the left and right direction Y. Thus, an operability of the sheet supplying operation for supplying the sheets P to P is compromised.

In view of this, in the second embodiment-1, the notched portion 2023 is provided at the corner portion between the upper edge 2023*a* of the front surface 2021 of the casing 202 and the side edge 2023*b* on the one side. Thus, the supplying of the sheets P to P (especially, the supplying of the sheets P to P from the front surface 2021) is less likely to be hindered by the corner portion between the upper edge 2023*a* of the front surface 2021 of the casing 202 and the side edge on one side in the left and right direction Y. Thus, a higher operability of the sheet supplying operation for supplying the sheets P to P can be achieved.

The casing 202 provided with the notched portion 2023 compromises the appearance, and may also compromise the safety with the feeding operation state of the sheets P exposed through the notched portion 2023.

In view of this, in the second embodiment-2, the notched portion 2023 is covered and thus hidden by the openable cover 201 in the closed state. Thus, the appearance can be improved. Furthermore, the feeding operation state of the sheet P can be prevented from exposing through the notched portion 2023, thus the safety can be effectively prevented from compromising.

In the second embodiment-3, the notched portion 2023 serves as the opening portion through which the back surface side position restricting member 222*b* can be visually recognized. Thus, the user can visually recognize the back surface side position restricting member 222*b* (for example, the upstream side end of the back surface side position restricting member 222*b* in the sheet feed direction Y1 or the sheet stacking upper limit position Qmax indicated by the label LB) through the notched portion 2023 serving as the opening portion. Thus, the sheets P to P can be more easily stacked along the back surface side position restricting member 222*b* on the stacking tray 221. Thus, the sheets P to P can be certainly stacked on the stacking tray 221, all things considered, a higher operability of the sheet supplying operation can be achieved.

Third Embodiment

In the third embodiment, the position restricting member 222 (in this example, the front surface side position restricting member 222*a* and the back surface side position restricting member 222*b*) and the openable cover 201 are configured as follows. Specifically, when the openable cover 201 is open, the distance L1 larger than the size L2 of the sheets P to P is provided between the end portion 2221 of the position restricting member 222 (222*a*, 222*b*) on the openable cover side and the uppermost portion 201*b* of the openable cover 201 in the upper and lower direction Z. Thus, a sufficient space for supplying the sheet P can be provided between the end portion 2221 of the position restricting member 222 (222*a*, 222*b*) on the openable cover side and the uppermost portion 201*b* of the openable cover 201. Thus, the supplying of the sheets P to P is less likely to be hindered by the uppermost portion 201*b* of the openable cover 201, whereby a higher operability of the sheet supplying operation for supplying the sheets P can be achieved.

Fourth Embodiment

In the fourth embodiment, the openable cover 201 is opened and closed in the sheet feed direction Y1 in which the sheet P is fed, whereby a higher operability of the sheet supplying operation for supplying the sheets P can be achieved.

Other Embodiments

The sheet feed device 200, which is a large capacity sheet feeder in the present embodiment, may be any device in which the sheets P, stacked on the stacking tray 221 and lifted to the sheet feed position Q1 by the lifting/lowering device 230, can be fed in the sheet feed direction Y1 with the pair of supply rollers 211*b* and 211*c*. For example, the sheet feed device 200 may be provided in the image forming apparatus main body 110.

The present invention is not limited to the embodiments described above, and can be embodied in various other forms. The embodiments are given by way of example in any way and should not be interpreted in a limiting sense. The scope of the present invention is defined on the basis of the scope of the appended claims, and is not restricted by the other parts of the present application in any way. The present invention includes all changes and modifications that fall within the scope of the appended claims and equivalents thereof.

REFERENCE SIGNS LIST

100 image forming apparatus
120 control unit
121 processing unit
122 storage unit
200 sheet feed device
201 openable cover (an example of openable member)
201*a* rotational shaft
201*b* uppermost portion
202 casing
2021 front surface
2022 right side surface
2023 notched portion
2023*a* upper side
2023*b* side edge
203 side cover
210 sheet feed unit
211*a* pickup rollers
211*b* first supply roller
211*c* second supply roller
211*e* conveyance roller
221 stacking tray
2211 sheet stacking surface
222 position restricting member
2221 end portion
222*a* front surface side position restricting member
222*b* back surface side position restricting member
230 lifting/lowering device (an example of lifting/lowering control unit)
231 lift mechanism
232 lift driving unit
232*a* lift driving motor
232*b* lift driving force transmission mechanism
261 lowering detection unit
262 openable cover detection unit (an example of openable member detection unit)
263 sheet detection unit
264 sheet supplying position detection unit
265 lower limit position detection unit
L1 distance
L2 size
P sheet
Q1 sheet feed position
Q2 sheet supplying position
Q3 lower limit position
Qmax sheet stacking upper limit position
X depth direction
X1 front surface side
X2 back surface side
Y left and right direction
Y1 sheet feed direction
Y2 opposite direction
Z upper and lower direction

What is claimed is:

1. A sheet feed device comprising:

a stacking tray on which sheets are stacked in such a manner as to be capable of being lifted and lowered;

an opening/closing member;

a lifting/lowering control unit configured to lift and lower the stacking tray; and an opening/closing member detection unit configured to detect an open/closed state of the opening/closing member, wherein when the opening/closing member is open, a sheet stacking surface on which the sheets are stacked is positioned at a position higher, in an upper and lower direction of the sheet feed device, than an uppermost portion of the opening/closing member in the upper and lower direction, wherein the lifting/lowering control unit is configured to control a lifting/lowering operation for the stacking tray, wherein when closing of the opening/closing member is detected by the opening/closing member detection unit, the lifting/lowering control unit controls the lifting/lowering operation for the stacking tray in such a manner that the sheet stacking surface is positioned at an upper position higher than a predetermined sheet supplying position at which the sheets are supplied, and wherein when opening of the opening/closing member is detected by the opening/closing member detection unit, the lifting/lowering control unit controls the lifting/lowering operation for the stacking tray in such a manner that the sheet stacking surface is lowered from the upper position to be positioned at the sheet supplying position.

2. The sheet feed device according to claim 1, wherein the sheet stacking surface is an upper surface of the stacking tray, when the sheets are not on the stacking tray.

3. The sheet feed device according to claim 1, wherein the sheet stacking surface is an upper surface of an uppermost one of the sheets, when the sheets are stacked on the stacking tray.

4. The sheet feed device according to claim 1 further comprising a sheet detection unit configured to detect a presence of the sheets on the stacking tray, wherein when the presence of the sheets on the stacking tray is detected by the sheet detection unit and closing of the opening/closing member is detected by the opening/closing member detection unit, the lifting/lowering control unit controls the lifting/lowering operation for the stacking tray in such a manner that the sheet stacking surface is positioned at the upper position.

5. The sheet feed device according to claim 1 further comprising:

a lifting/lowering control unit configured to lift and lower the stacking tray;

a sheet detection unit configured to detect a presence of the sheets on the stacking tray; and an opening/closing member detection unit configured to detect an open/closed state of the opening/closing member, wherein the lifting/lowering control unit is configured to control a lifting/lowering operation for the stacking tray, and wherein when an absence of the sheets on the stacking tray is detected by the sheet detection unit and closing of the opening/closing member is detected by the opening/closing member detection unit, the lifting/lowering control unit controls the lifting/lowering operation for the stacking tray in such a manner that the sheet stacking surface is positioned at a predetermined sheet supplying position at which the sheets are supplied.

6. The sheet feed device according to claim 5, wherein when opening of the opening/closing member is detected by the opening/closing member detection unit, the lifting/lowering control unit controls the lifting/lowering operation for the stacking tray in such a manner that the sheet stacking surface is maintained at the sheet supplying position.

7. The sheet feed device according to claim 1, further comprising:

a lifting/lowering control unit configured to lift and lower the stacking tray;

a sheet detection unit configured to detect a presence of the sheets on the stacking tray; and an opening/closing member detection unit configured to detect an open/closed state of the opening/closing member, wherein the lifting/lowering control unit is configured to control a lifting/lowering operation for the stacking tray, and wherein when an absence of the sheets on the stacking tray is detected by the sheet detection unit and closing of the opening/closing member is detected by the opening/closing member detection unit, the lifting/lowering control unit controls the lifting/lowering operation for the stacking tray in such a manner that the sheet stacking surface is positioned at a lower position lower than a predetermined sheet supplying position at which the sheets are supplied.

8. The sheet feed device according to claim 7, wherein when opening of the opening/closing member is detected by the opening/closing member detection unit, the lifting/lowering control unit controls the lifting/lowering operation for the stacking tray in such a manner that the sheet stacking surface is lifted from the lower position to be positioned at the sheet supplying position.

9. The sheet feed device according to claim 1 further comprising a sheet supplying position detection unit configured to detect whether the sheet stacking surface of the stacking tray is higher than the sheet supplying position, wherein when the sheet stacking surface is detected to be higher than the sheet supplying position by the sheet supplying position detection unit, the lifting/lowering control unit performs a lowering operation for the stacking tray, and wherein when the sheet stacking surface is detected to become not higher than the sheet supplying position by the sheet supplying position detection unit, the lifting/lowering control unit stops the lowering operation for the stacking tray.

10. The sheet feed device according to claim 1, wherein the opening/closing member is opened and closed in a sheet feed direction in which the sheets are fed.

11. An image forming apparatus comprising the sheet feed device according to claim 1.

12. A sheet feed device comprising:

a stacking tray on which sheets are stacked in such a manner as to be capable of being lifted and lowered;

an opening/closing member; and a casing accommodating the stacking tray, wherein the opening/closing member is configured to be openable and closable in such a manner that the sheets are supplied from one side of a left and right direction of the sheet feed device, wherein the casing has a front surface with the one side partially notched to have a notched portion, and wherein the opening/closing member is configured to cover the notched portion when the opening/closing member is closed.

13. The sheet feed device according to claim 12, wherein the notched portion is formed in a corner portion between an upper edge of the front surface of the casing and a side edge on the one side.

14. The sheet feed device according to claim 12 further comprising a back surface side position restricting member configured to restrict a movement of the sheets stacked on the stacking tray toward a back surface side opposite to a side of the front surface, wherein the notched portion also serves as an opening portion through which the back surface side position restricting member can be visually recognized.

15. An image forming apparatus comprising the sheet feed device according to claim 12.

* * * * *